US007907877B2

(12) United States Patent
Yamada

(10) Patent No.: US 7,907,877 B2
(45) Date of Patent: Mar. 15, 2011

(54) DEVELOPING DEVICE, IMAGE FORMING APPARATUS, AND IMAGE FORMING SYSTEM

(75) Inventor: Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 417 days.

(21) Appl. No.: 12/121,640

(22) Filed: May 15, 2008

(65) Prior Publication Data

US 2008/0298852 A1 Dec. 4, 2008

(30) Foreign Application Priority Data

May 30, 2007 (JP) ..... 2007-144066

(51) Int. Cl.
*G03G 15/09* (2006.01)
*G03G 15/08* (2006.01)

(52) U.S. Cl. ..... 399/279; 399/284

(58) Field of Classification Search ..... 399/264, 399/274, 279, 284
See application file for complete search history.

(56) References Cited

U.S. PATENT DOCUMENTS 4,780,741 A * 10/1988 Wada et al. ..... 399/274
5,387,966 A 2/1995 Karashima
6,183,927 B1 * 2/2001 Magome et al. ..... 430/108.3
6,360,069 B1 3/2002 Mimura et al.
6,925,277 B2 8/2005 Sugihara
2006/0056880 A1 * 3/2006 Okamoto ..... 399/284

FOREIGN PATENT DOCUMENTS

JP 08286497 A 11/1996
JP 09197800 A 7/1997
JP 11174821 A 7/1999
JP 2001134069 A 5/2001
JP 2002-372855 12/2002
JP 2003-057940 2/2003
JP 2004020581 A 1/2004
JP 2004034537 A 2/2004
JP 2004-212520 7/2004
JP 2005-049649 2/2005
JP 2006-259384 9/2006

* cited by examiner

*Primary Examiner* — David M Gray
*Assistant Examiner* — Rodney Bonnette
(74) *Attorney, Agent, or Firm* — DLA Piper LLP (US)

(57) ABSTRACT

A developing device has a rotatable toner bearing member that bears toner having a particulate external additive externally added to core particles. Projecting sections are arranged in a regular manner on a surface of the toner bearing member. A longitudinal direction of a regulation member runs along an axial direction of the toner bearing member, and a leading edge of the regulation member in lateral and thickness directions faces an upstream side in a rotating direction of the toner bearing member. A relationship among the volume mean toner particle size A, the volume mean external additive particle size B, the ten-point average protrusion roughness. C, and the distance D between the leading edge and projecting sections is C <B <D <A.

8 Claims, 16 Drawing Sheets

DEVELOPING DEVICE, IMAGE FORMING APPARATUS, AND IMAGE FORMING SYSTEM

CROSS-REFERENCE TO RELATED APPLICATIONS

The present application claims priority to Japanese Patent Application No. 2007-144066 filed on May 30, 2007, which is herein incorporated by reference.

BACKGROUND

1. Technical Field

The present invention relates to developing devices, image forming apparatuses, and image forming systems.

2. Related Art

Image forming apparatuses such as laser beam printers are well known. Such image forming apparatuses include, for example, an image bearing member that bears a latent image, and a developing device that develops the latent image borne on the image bearing member using toner. In the case where an image signal or the like is sent from an external device such as a computer, the image forming apparatus forms a toner image on the image bearing member by developing the latent image borne on the image bearing member using the developing device. Then, the image forming apparatus transfers the toner image to a medium and finally the image is formed on the medium.

The developing device is provided with a toner bearing member that bears toner and develops the latent image borne on the image bearing member using toner, and a regulation member that comes into contact with a contact section on a surface of the toner bearing member to regulate an amount of toner borne on that surface. The toner bearing member is provided with projecting sections that are arranged in a regular manner on its surface, and bears toner on the projecting sections and in portions of its surface other than the projecting sections. The regulation member is arranged so that a longitudinal direction of the regulation member runs along an axial direction of the toner bearing member, and so that a leading edge of the regulation member in a lateral direction and a thickness direction faces an upstream side of the toner bearing member in a rotating direction. In this developing device, after the toner borne on the toner bearing member is regulated by the regulation member, the toner is supplied for the development of the latent image on the image bearing member.

Patent document 1: JP-A-2006-259384

Patent document 2: JP-A-2003-57940

By the way, there are cases where a toner having a slow charging rise (toner that takes time for its charging amount to reach a saturated charge amount) is used as the toner in this image forming apparatus. And a phenomenon called development memory can occur due to the slowness of the charging rise when the latent image is to be developed using this toner. And occurrences of this phenomenon are a cause of deterioration of image quality in images.

Accordingly, to inhibit the aforementioned development memory, a system is conceivable in which the latent image is developed using toner borne on portions other than the projecting sections on the surface of the toner bearing member. And this system is achievable by bringing the regulation member into contact with the toner bearing member so that a distance between the leading edge and the projecting sections in the case where the leading edge of the regulation member faces the projecting sections of the toner bearing member is smaller than a volume mean particle size of the toner.

However, in regard to the above description, it becomes difficult for the toner to be borne on the projecting sections, and the contact section of the regulation member may come into direct contact with the projecting sections without toner interposed therebetween. In the case where the contact section comes into direct contact with the projecting sections, the contact section adheres closely to the projecting sections undesirably, and due to this, problems such as unusual sounds may occur between the toner bearing member and the contact section during rotation.

SUMMARY

The invention is devised in light of these issues, and it is an advantage thereof to appropriately prevent deterioration in image quality of images and to cause the regulation member to come into contact with the toner bearing member appropriately.

A primary aspect of the invention for addressing these issues involves:

a developing device, provided with:

a toner bearing member that bears toner that has core particles and a particulate external additive externally added to the core particles, and that develops a latent image borne on an image bearing member using the toner, the toner bearing member being rotatable and having projecting sections arranged in a regular manner on a surface of the toner bearing member; and a regulation member that regulates an amount of toner borne on a surface of the toner bearing member by coming into contact with that surface at a contact section, the regulation member being arranged so that a longitudinal direction of the regulation member runs along an axial direction of the toner bearing member, and so that a leading edge of the regulation member in a lateral direction and a thickness direction faces an upstream side in a rotating direction of the toner bearing member, wherein in the case where a volume mean particle size of the toner is set to a toner particle size A, a volume mean particle size of the external additive is set to an external additive particle size B, a ten-point average roughness of the projecting sections is set to a protrusion roughness C, and a distance between the leading edge and the projecting sections in the case where the leading edge of the regulation member faces the projecting sections is set to a distance D, a relationship among sizes of the toner particle size A, the external additive particle size B, the protrusion roughness C, and the distance D is so that the protrusion roughness C<the external additive particle size B<the distance D<the toner particle size A.

Other features of the invention will be made clear by reading the description of the present specification with reference to the accompanying drawings.

BRIEF DESCRIPTION OF THE DRAWINGS

For a more complete understanding of the invention and the advantages thereof, reference is now made to the following description taken in conjunction with the accompanying drawings wherein.

DESCRIPTION OF EXEMPLARY EMBODIMENTS

Figure 1:
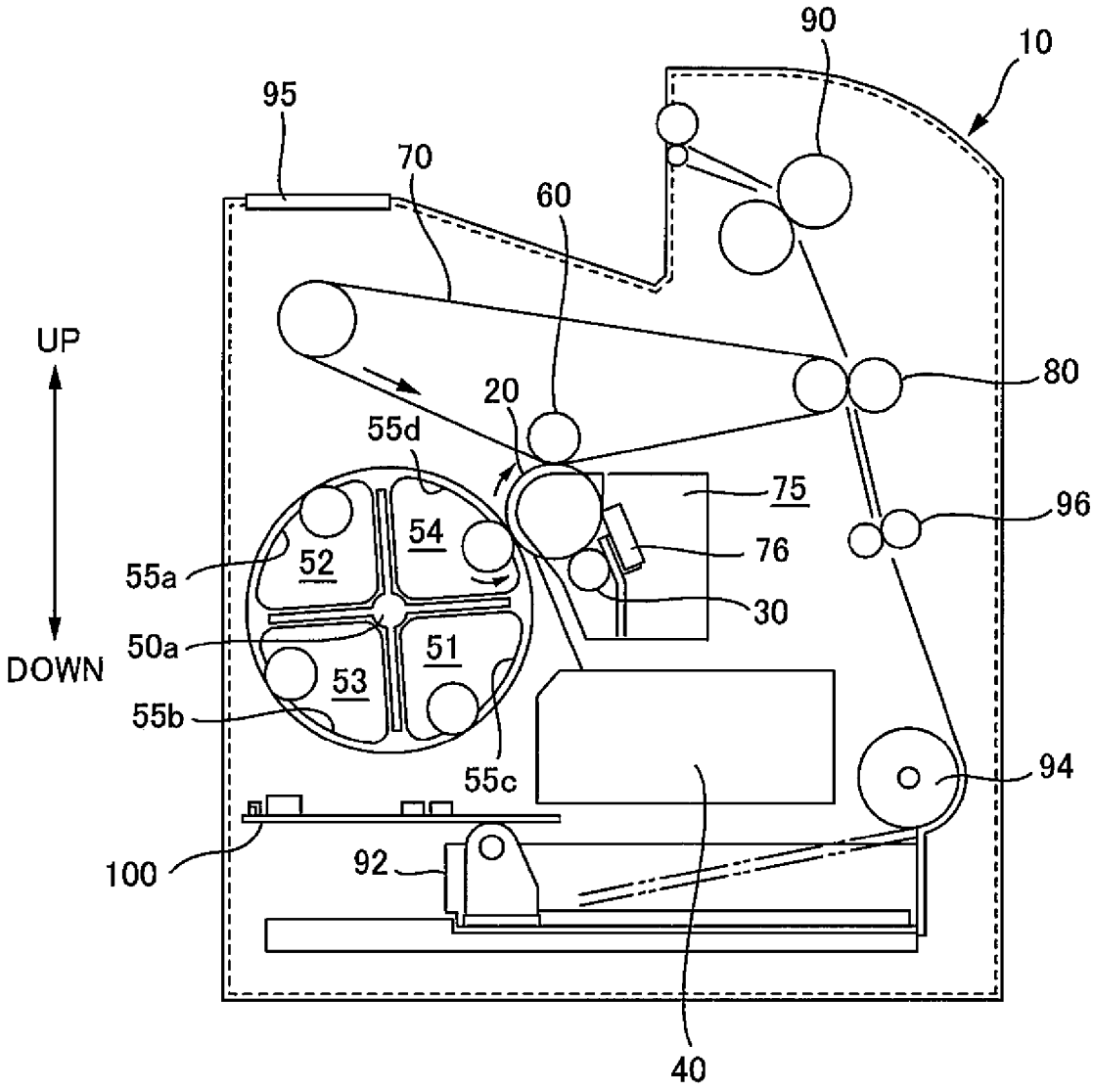
FIG. 1 is a diagram showing main structural components constituting a printer 10.

At least the following matters will be made clear by the present specification and the accompanying drawings.

A developing device, provided with:

a toner bearing member that bears toner that has core particles and a particulate external additive externally added to the core particles, and that develops a latent image borne on an image bearing member using the toner, the toner bearing member being rotatable and having projecting sections arranged in a regular manner on a surface of the toner bearing member; and a regulation member that regulates an amount of toner borne on a surface of the toner bearing member by coming into contact with that surface at a contact section, the regulation member being arranged so that a longitudinal direction of the regulation member runs along an axial direction of the toner bearing member, and so that a leading edge of the regulation member in a lateral direction and a thickness direction faces an upstream side in a rotating direction of the toner bearing member, wherein in the case where a volume mean particle size of the toner is set to a toner particle size A, a volume mean particle size of the external additive is set to an external additive particle size B, a ten-point average roughness of the projecting sections is set to a protrusion roughness C, and a distance between the leading edge and the projecting sections in the case where the leading edge of the regulation member faces the projecting sections is set to a distance D, a relationship among sizes of the toner particle size A, the external additive particle size B, the protrusion roughness C, and the distance D is so that the protrusion roughness C<the external additive particle size B<the distance D<the toner particle size A. With this development apparatus, it is possible to appropriately prevent deterioration in image quality of images and to cause the regulating member to come into contact with the toner bearing member appropriately.

Furthermore, in the developing device, it is preferable that:

the projecting sections and depressed sections that bear the toner are arranged in a regular manner on a surface of the toner bearing member, the depressed sections are bottom portions of two types of spiral groove portions having different inclination angles with respect to a circumferential direction of the toner bearing member, the two types of spiral groove portions mutually intersect so as to form a grid pattern, the projecting sections are a square top surface surrounded by the two types of spiral groove portions, and one of two diagonal lines of the square top surface runs along the circumferential direction.

Furthermore, in the developing device, it is preferable that:

a small groove that is formed during processing of the toner bearing member and that runs along the circumferential direction of the toner bearing member is provided on the projecting sections. In this case, the contact section of the regulation member can be effectively prevented from adhering closely to the toner bearing member.

Furthermore, in the developing device, it is preferable that:

the small groove is provided so as to not connect from one end to another end in the circumferential direction of the protrusion on which the small groove is provided. In this case, the contact section of the regulation member can be more effectively prevented from adhering closely to the toner bearing member.

Furthermore, in the developing device, it is preferable that:

the toner is provided with a plurality of types of the external additives that are externally added to the core particles, and the external additive particle size B is a volume mean particle size of an external additive having a largest volume mean particle size among the plurality of types of external additives. In this case, the contact section of the regulation member can be more effectively prevented from adhering closely to the toner bearing member.

Furthermore, in the developing device, it is preferable that:

the regulation member is constituted by a rubber elastic member. In this case, the effect of appropriately bringing the projecting sections into contact with the contact section is achieved more effectively.

Furthermore, an image forming apparatus provided with a developing device can be achieved, the developing device including (a) an image bearing member for bearing a latent image, (b) a toner bearing member that bears toner that has core particles and a particulate external additive externally added to the core particles, and that develops the latent image borne on the image bearing member using the toner, the toner bearing member being rotatable and having projecting sections arranged in a regular manner on a surface of the toner bearing member, and (c) a regulation member that regulates an amount of toner borne on a surface of the toner bearing member by coming into contact with that surface of the toner bearing member at a contact section, the regulation member being arranged so that a longitudinal direction of the regulation member runs along an axial direction of the toner bearing member, and so that a leading edge of the regulation member in a lateral direction and a thickness direction faces an upstream side in a rotating direction of the toner bearing member, wherein when a volume mean particle size of the toner is set to a toner particle size A, a volume mean particle size of the external additive is set to an external additive particle size B, a ten-point average roughness of the projecting sections is set to a protrusion roughness C, and a distance between the leading edge and the projecting sections when the leading edge of the regulation member faces the projecting sections is set to a distance D, the developing device is so that a relationship among sizes of the toner particle size A, the external additive particle size B, the protrusion roughness C, and the distance D is so that the protrusion roughness C<the external additive particle size B<the distance D<the toner particle size A. With this image forming apparatus, it is possible to appropriately prevent deterioration in image quality of images and to cause the regulating member to come into contact with the toner bearing member appropriately.

Furthermore, an image forming system can be achieved equipped with:

(A) a computer; and (B) an image forming apparatus that is connectable to the computer, the image forming apparatus including a developing device provided with (a) an image bearing member for bearing a latent image, (b) a toner bearing member that bears toner that has core particles and a particulate external additive externally added to the core particles, and that develops the latent image borne on the image bearing member using the toner, the toner bearing member being rotatable and having projecting sections arranged in a regular manner on a surface of the toner bearing member, and (c) a regulation member regulates an amount of toner borne on a surface of the toner bearing member by coming into contact with that surface of the toner bearing member at a contact section and, the regulation member being arranged so that a longitudinal direction of the regulation member runs along an axial direction of the toner bearing member, and so that a leading edge of the regulation member in a lateral direction and a thickness direction faces an upstream side in a rotating direction of the toner bearing member, wherein when a volume mean particle size of the toner is set to a toner particle size A, a volume mean particle size of the external additive is set to an external additive particle size B, a ten-point average roughness of the projecting sections is set to a protrusion roughness C, and a distance between the leading edge and the projecting sections in the case where the leading edge of the regulation member faces the projecting sections is set to a distance D, the developing device is so that a relationship among sizes of the toner particle size A, the external additive particle size B, the protrusion roughness C, and the distance D is so that the protrusion roughness C<the external additive particle size B<the distance D<the toner particle size A. With this image forming system, it is possible to appropriately prevent deterioration in image quality of images and to cause the regulation member to come into contact with the toner bearing member appropriately.

Example of Overall Configuration of Image Forming Apparatus

Next, using FIG. 1, an outline of a laser beam printer (hereinafter, also referred to as "printer") 10 serving as an example of an image forming apparatus is described. FIG. 1 is a diagram showing the main structural components constituting the printer 10. It should be noted that in FIG. 1, the vertical direction is indicated by the arrows, and, for example, a paper supply tray 92 is arranged at a lower section of the printer 10 and a fixing unit 90 is arranged at an upper section of the printer 10.

As shown in FIG. 1, the printer 10 according to the present embodiment includes a charging unit 30, an exposing unit 40, a YMCK developing unit 50, a first transferring unit 60, an intermediate transferring member 70, and a cleaning unit 75, these units being arranged along the direction of rotation of a photoconductor 20, which serves as an example of an image bearing member, and the printer 10 further includes a second transferring unit 80, a fixing unit 90, a display unit 95 constituted by a liquid crystal panel and serving as a means for making notifications to the user, and a control unit 100 for controlling these units and the like and managing operations of the printer.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow in FIG. 1.

The charging unit 30 is a device for charging the photoconductor 20, and the exposing unit 40 is a device that irradiates a laser beam to form a latent image on the charged photoconductor 20. The exposing unit 40 includes, for example, a semiconductor laser, a polygon mirror, and an F-θ lens, and irradiates a modulated laser beam onto the charged photoconductor 20 in accordance with image signals that have been inputted from a host computer, not shown in the drawings, such as a personal computer or a word processor.

The YMCK developing unit 50 is a device that uses a toner T contained in the developing device to develop the latent image formed on the photoconductor 20, the toner T being a black (K) toner contained in a black developing device 51, a magenta (M) toner contained in a magenta developing device 52, a cyan (C) toner contained in a cyan developing device 53, and a yellow (Y) toner contained in a yellow developing device 54.

By rotating the YMCK developing unit 50 in a state in which the four developing devices 51, 52, 53, and 54 are mounted, it is possible to move the positions of these four developing devices 51, 52, 53, and 54. More specifically, the YMCK developing unit 50 holds the four developing devices 51, 52, 53, and 54 with four holding sections 55*a*, 55*b*, 55*c*, and 55*d*, and the four developing devices 51, 52, 53, and 54 can be rotated around a central shaft 50*a* while maintaining their relative positions. Every time the image forming corresponding to one page is finished, the developing devices are caused to selectively oppose the photoconductor 20, thereby successively developing the latent image formed on the photoconductor 20 using the toner T contained in the developing devices 51, 52, 53, and 54. It should be noted that each of the four developing devices 51, 52, 53, and 54 can be removed from the holding sections of the YMCK developing unit 50. The developing devices are described in detail further below.

The first transferring unit 60 is a device for transferring a single color toner image formed on the photoconductor 20 to the intermediate transferring member 70, and when the four toner colors are successively transferred over one another, a full color toner image is formed on the intermediate transferring member 70.

The intermediate transferring member 70 is an endless belt made by providing a tin vapor deposition layer on the surface of a PET film and forming in a layered manner a semiconductive coating on its surface, and the intermediate transferring member 70 is driven to rotate at substantially the same circumferential speed as the photoconductor 20.

The second transferring unit 80 is a device for transferring the single-color toner image or the full-color toner image formed on the intermediate transferring body 70 onto a medium such as paper, film, or cloth.

The fixing unit 90 is a device for fusing the single-color toner image or the full-color toner image, which has been transferred to the medium, onto the medium to turn it into a permanent image.

The cleaning unit 75 is a device that is provided between the first transferring unit 60 and the charging unit 30, that has a rubber cleaning blade 76 that comes into contact with the surface of the photoconductor 20, and that is for removing the toner T remaining on the photoconductor 20 by scraping it off with the cleaning blade 76 after the toner image has been transferred onto the intermediate transferring member 70 by the first transferring unit 60.

Figure 2:
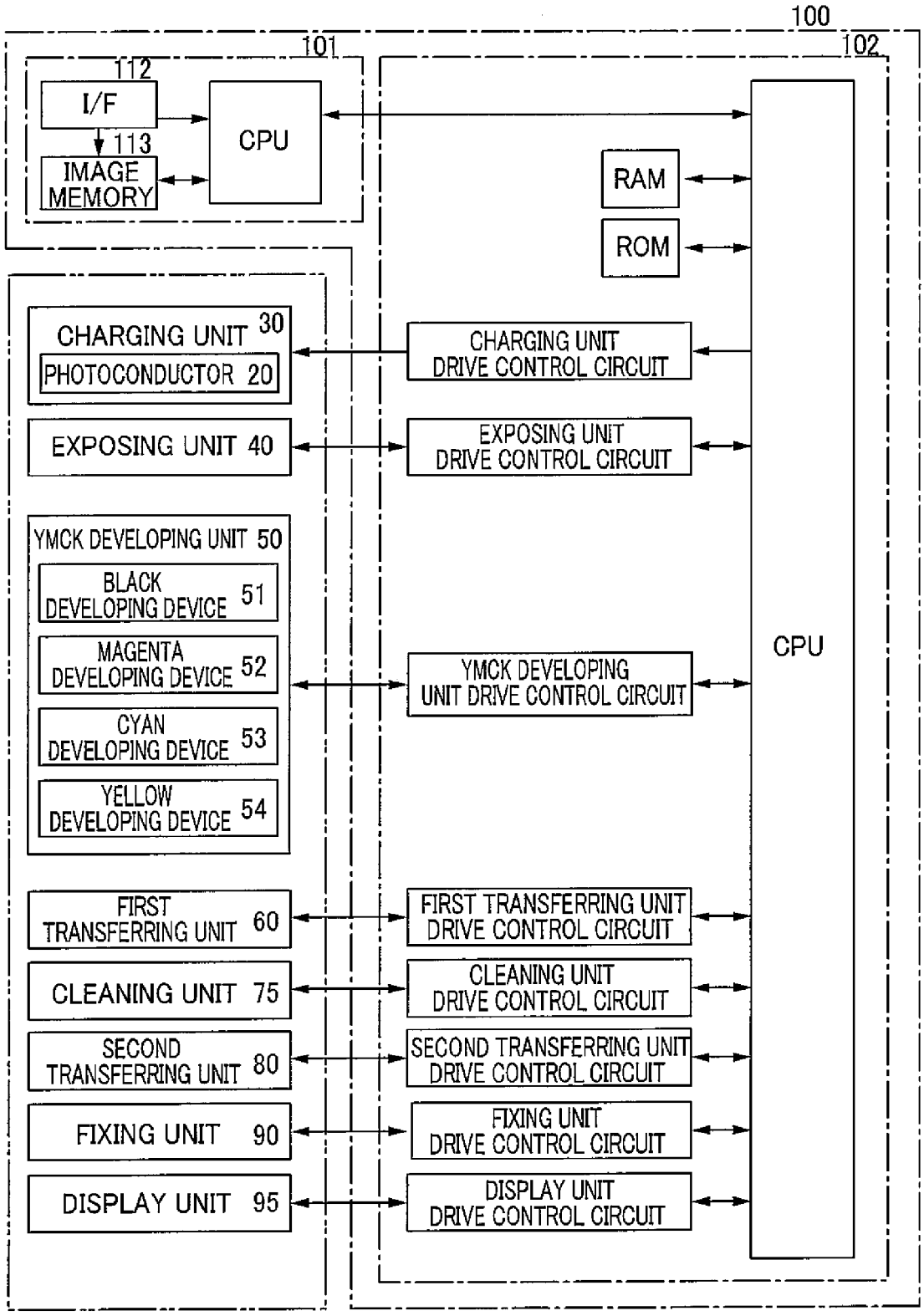
FIG. 2 is a block diagram showing a control unit of the printer 10 in FIG. 1.

The control unit 100 includes a main controller 101 and a unit controller 102 as shown in FIG. 2. An image signal and a control signal are inputted into the main controller 101, and in accordance with a command based on the image signal and the control signal, the unit controller 102 controls the various units, for example, to form the image.

Next, description will be given regarding the operation of the printer 10 configured as above.

First, when image signals and control signals from a host computer (not shown) are inputted to the main controller 101 of the printer 10 via an interface (I/F) 112, the photoconductor 20 and the intermediate transferring member 70 are rotated under the control of the unit controller 102 in accordance with a command from the main controller 101. While rotating, the photoconductor 20 is successively charged by the charging unit 30 at a charging position.

The region of the photoconductor 20 that has been charged is brought to an exposure position through rotation of the photoconductor 20, and a latent image corresponding to image information of a first color, for example yellow Y, is formed in that region by the exposing unit 40. The YMCK developing unit 50 positions the yellow developing device 54, which contains yellow (Y) toner, at the developing position opposing the photoconductor 20.

The latent image formed on the photoconductor 20 is brought to the developing position by the rotation of the photoconductor 20, and is developed with yellow toner by the yellow developing device 54. Thus, a yellow toner image is formed on the photoconductor 20.

The yellow toner image that is formed on the photoconductor 20 is brought to the first transferring position through rotation of the photoconductor 20 and is transferred to the intermediate transferring member 70 by the first transferring unit 60. At this time, a first transferring voltage, which has an opposite polarity to the polarity to which the toner T is charged, is applied to the first transferring unit 60. It should be noted that, during this process, the photoconductor 20 and the intermediate transferring member 70 are in contact, whereas the second transferring unit 80 is kept apart from the intermediate transferring member 70.

By sequentially repeating the above-described processes with each of the developing devices for the second, the third, and the fourth color, toner images in four colors corresponding to the respective image signals are transferred to the intermediate transferring member 70 in a superimposed manner. Thus, a full color toner image is formed on the intermediate transferring member 70.

With the rotation of the intermediate transferring member 70, the full-color toner image formed on the intermediate transferring member 70 reaches a second transferring position, and is transferred onto the medium by the second transferring unit 80. It should be noted that the medium is transported from the paper supply tray 92 to the second transferring unit 80 via a paper supply roller 94 and registration rollers 96. Also, when performing the image transfer operation, the second transferring unit 80 is pressed against the intermediate transferring member 70 while applying a secondary transferring voltage to it.

The full-color toner image transferred onto the medium is heated and pressurized by the fixing unit 90 and thus fused to the medium.

On the other hand, after the photoconductor 20 has passed the first transferring position, the toner T adhering to the surface of the photoconductor 20 is scraped off by the cleaning blade 76 that is supported by the cleaning unit 75, and the photoconductor 20 is prepared for charging in order to form the next latent image. The scraped-off toner T is collected in a remaining-toner collector of the cleaning unit 75.

Overview of the Control Unit

Next, description is given regarding the configuration of the control unit 100 with reference to FIG. 2. The main controller 101 of the control unit 100 is electrically connected to the host computer via the interface 112, and is provided with an image memory 113 for storing image signals inputted into it from the host computer. The unit controller 102 is electrically connected to each of the units of the apparatus body (i.e., the charging unit 30, the exposing unit 40, the YMCK developing unit 50, the first transferring unit 60, the cleaning unit 75, the second transferring unit 80, the fixing unit 90, and the display unit 95), detects the state of the units by receiving signals from sensors provided in those units, and controls each of the units in accordance with the signals that are inputted from the main controller 101.

Configuration Example of the Developing device

Figure 3:
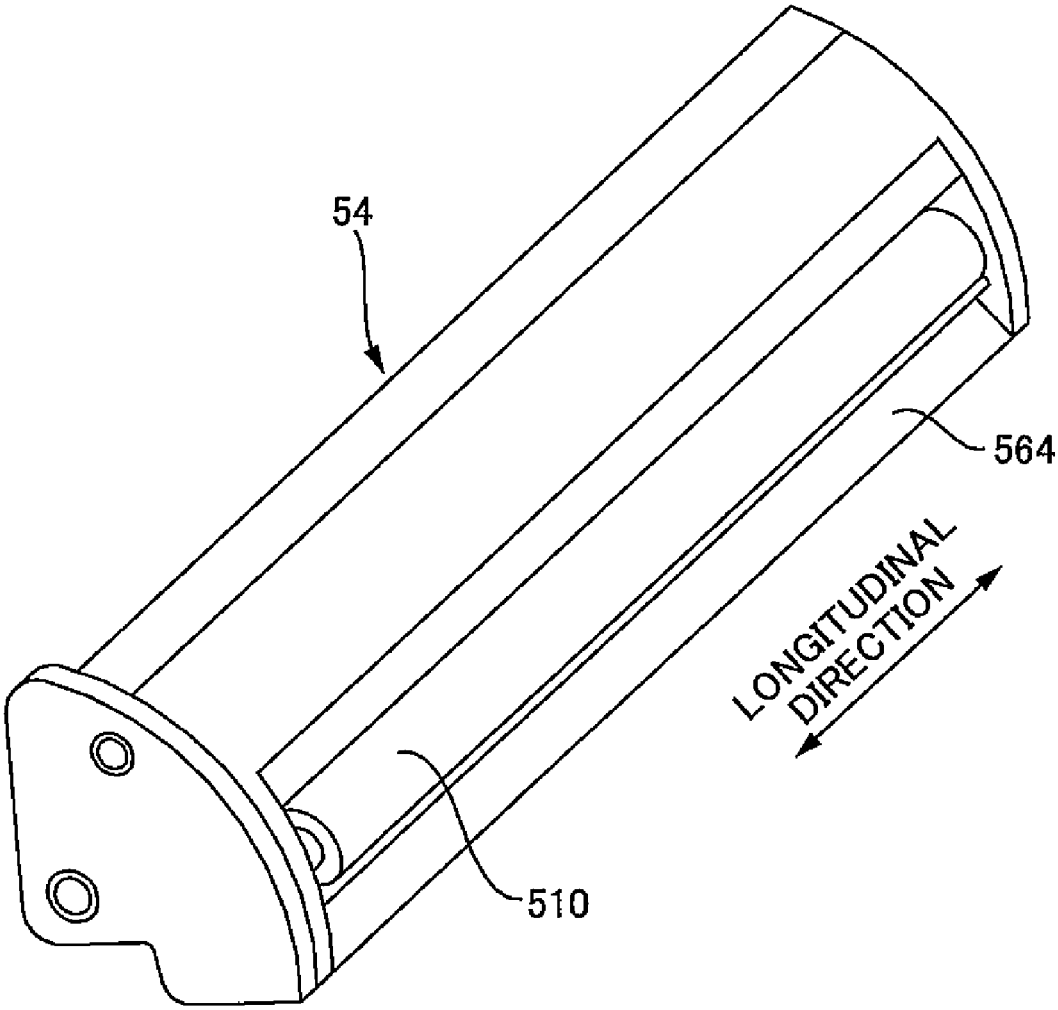
FIG. 3 is a schematic diagram of a developing device.
Figure 4:
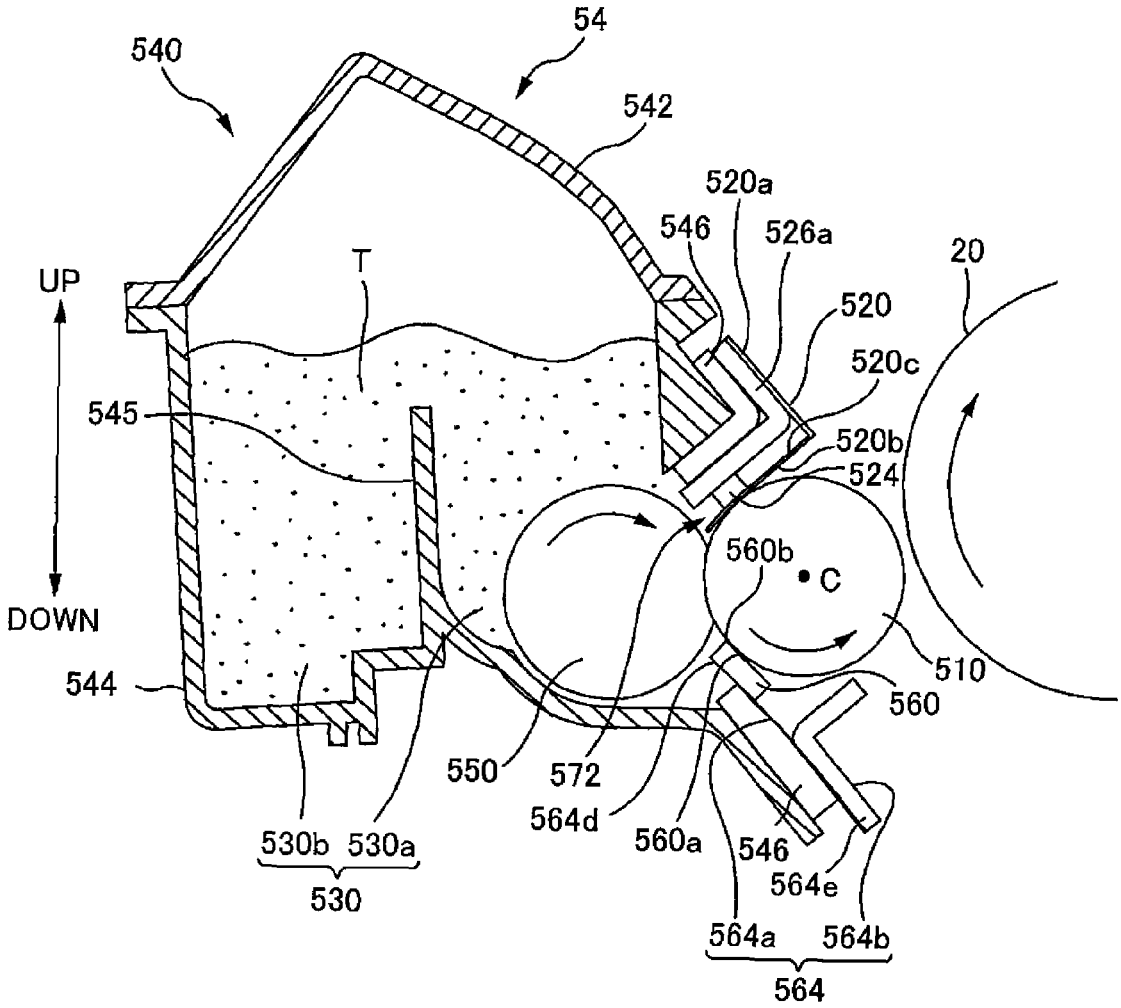
FIG. 4 a cross-sectional view showing main structural components of the developing device.
Figure 5:
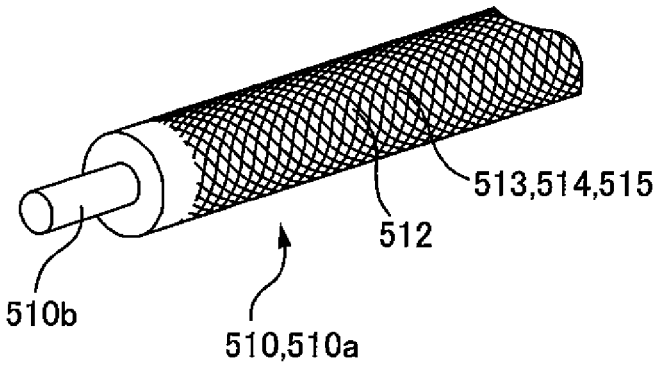
FIG. 5 is a perspective schematic diagram of a developing roller 510.
Figure 6:
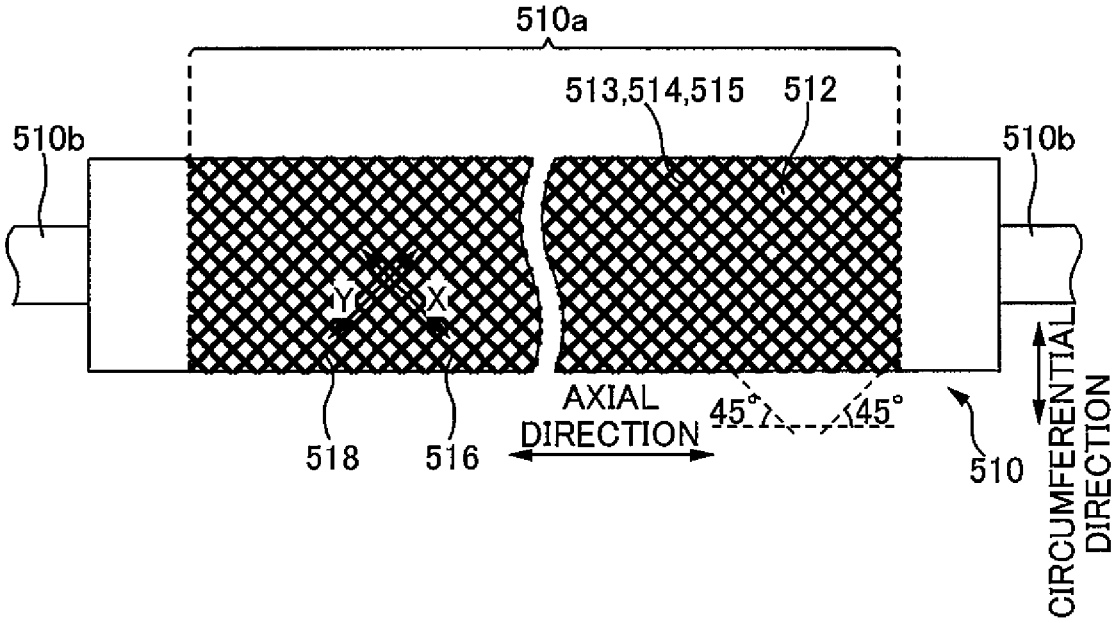
FIG. 6 is a front schematic diagram of the developing roller 510.
Figure 7:
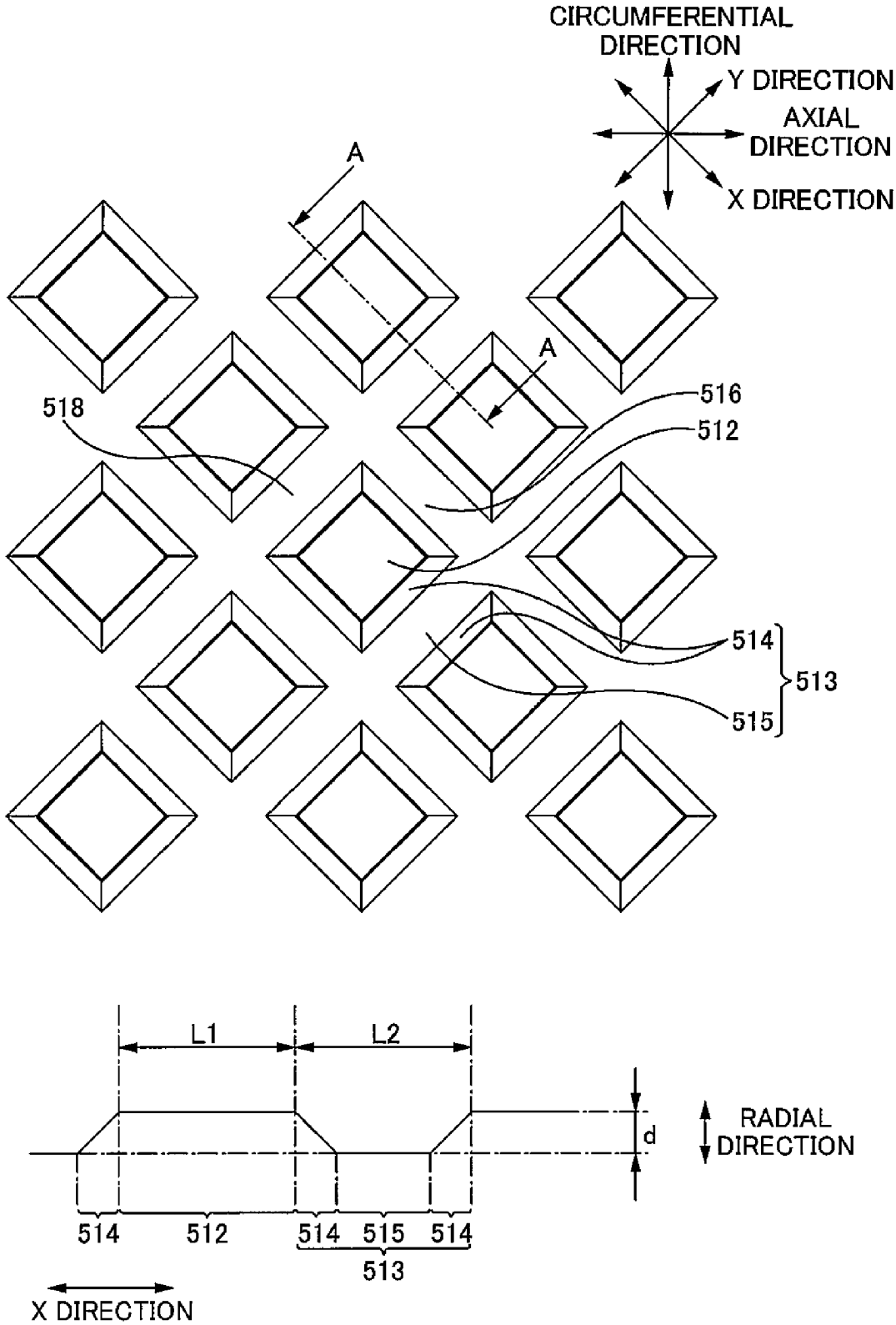
FIG. 7 is a schematic diagram showing shapes including projecting sections 512 and depressed sections 515.
Figure 8:
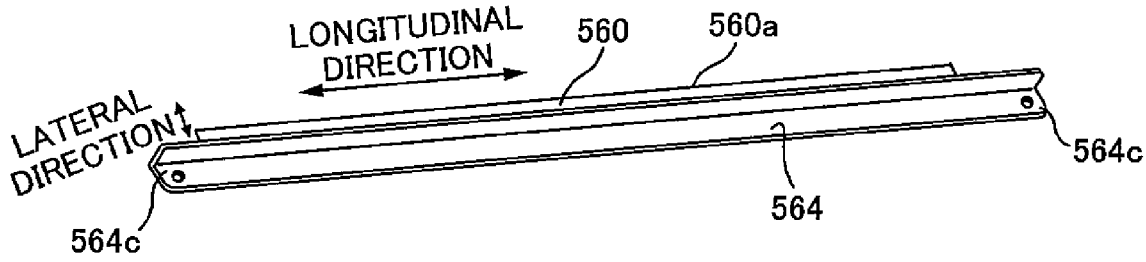
FIG. 8 is a perspective view of a regulation blade 560 and a blade-supporting member 564.
Figure 9:
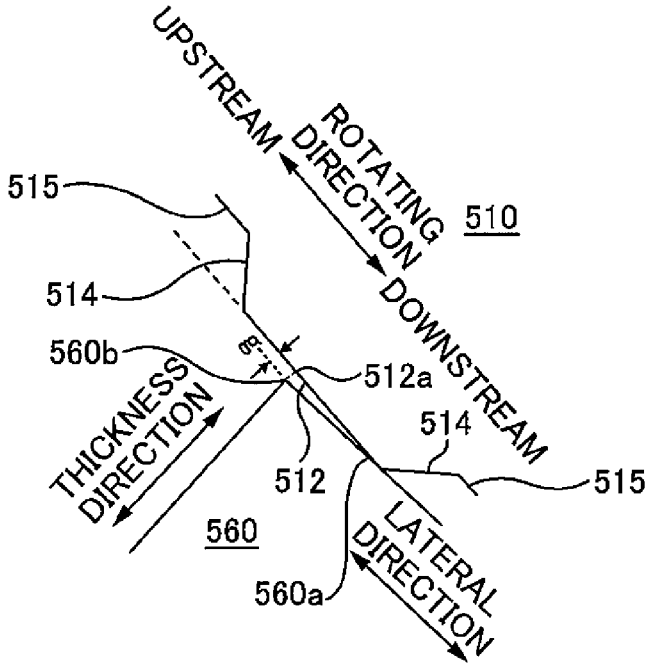
FIG. 9 is an enlarged schematic diagram showing a state near a contact section 560*a* of the regulation blade 560 that comes into contact with the developing roller 510.
Figure 10:
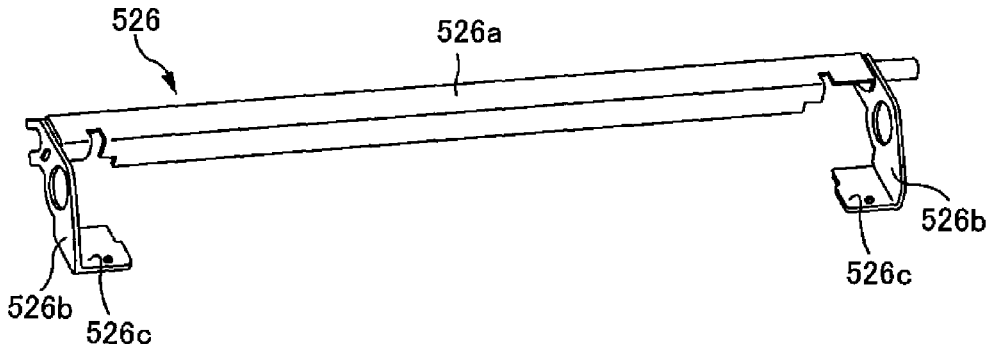
FIG. 10 is a perspective view of a holder 526.
Figure 11:
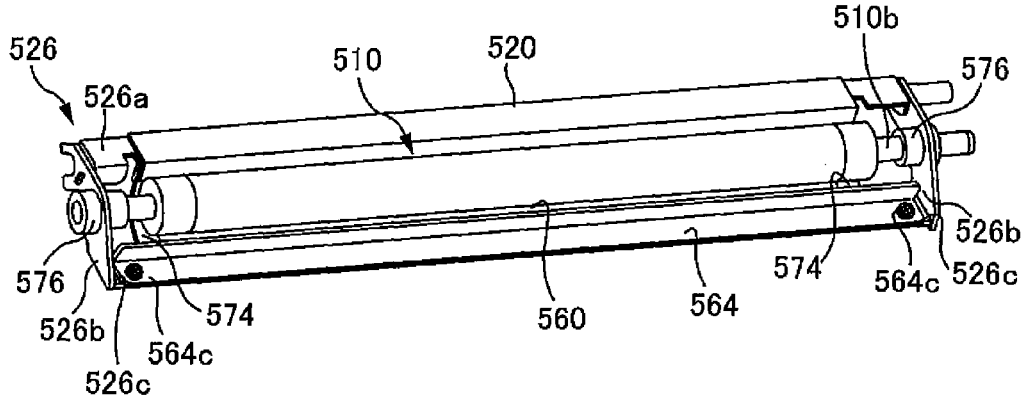
FIG. 11 is a perspective view illustrating the holder 526 to which an upper seal 520, the developing roller 510, the regulation blade 560, and the blade-supporting member 564 are attached in an assembled manner.
Figure 12:
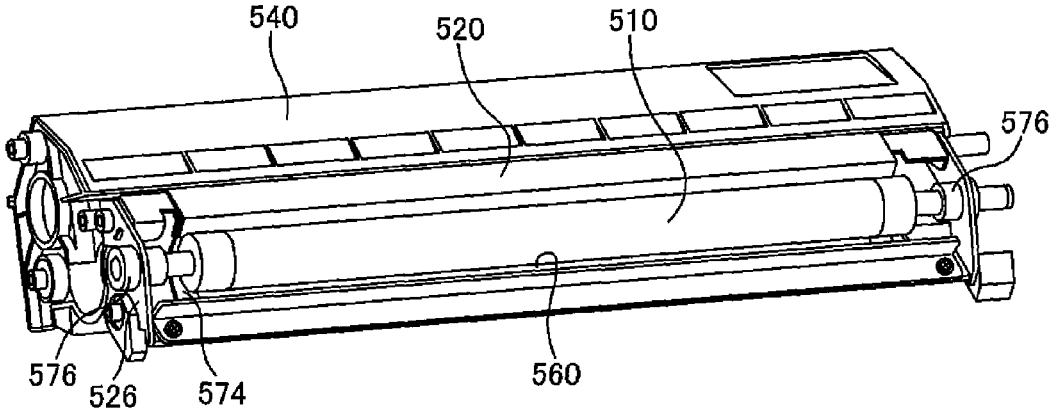
FIG. 12 is a perspective view illustrating the holder 526 attached to a housing 540.

Next, description is given regarding a configuration example of the developing devices using FIG. 3 to FIG. 12. FIG. 3 is a schematic diagram of the developing device. FIG. 4 is a cross-sectional view showing the main structural components of this developing device. FIG. 5 is a perspective schematic diagram of a developing roller 510. FIG. 6 is a front schematic diagram of the developing roller 510. FIG. 7 is a schematic diagram showing shapes including projecting sections 512 and depressed sections 515, and the lower diagram in FIG. 7 shows a cross-sectional shape of an A-A cross section in the upper diagram of FIG. 7. FIG. 8 is a perspective view of a regulation blade 560 and a blade-supporting member 564. FIG. 9 is an enlarged schematic diagram showing a state near a leading edge 560*b* of the regulation blade 560 that comes into contact with the developing roller 510. FIG. 10 is a perspective view of a holder 526. FIG. 11 is a perspective view illustrating the holder 526 to which an upper seal 520, the developing roller 510, the regulation blade 560, and the blade-supporting member 564 are attached in an assembled manner. FIG. 12 is a perspective view illustrating the holder 526 attached to a housing 540. It should be noted that the cross-sectional view shown in FIG. 4 shows a cross section of the developing device taken along a plane perpendicular to the longitudinal direction shown in FIG. 3. Moreover, in FIG. 4, as in FIG. 1, the vertical direction is indicated by arrows, and for example the central shaft of the developing roller 510 is in a lower position than the central shaft of the photoconductor 20. Also, in FIG. 4, the yellow developing device 54 is shown positioned at the developing position, which is in opposition to the photoconductor 20. Furthermore, in FIG. 5 to FIG. 7, and FIG. 9, the projecting sections 512 and the like are not to scale in order to make the diagrams easier to understand. Furthermore, the longitudinal direction and the lateral direction of the regulation blade 560 in FIG. 8 and the lateral direction and the thickness direction of the regulation blade 560 in FIG. 9 are shown with arrows respectively.

The YMCK developing unit 50 is provided with the black developing device 51 containing black (K) toner, the magenta developing device 52 containing magenta (M) toner, the cyan developing device 53 containing cyan (C) toner, and the yellow developing device 54 containing yellow (Y) toner. However, since the configuration of each of the developing devices is the same, only the yellow developing device 54 is described below.

The yellow developing device 54 includes the developing roller 510, which is an example of a toner bearing member, the upper seal 520, a toner container 530, the housing 540, a toner supply roller 550, the regulation blade 560, which is an example of a regulation member, the holder 526, and the like.

The developing roller 510 bears toner T and transports it by rotating to the developing position opposite the photoconductor 20, and develops the latent image borne on the photoconductor 20 using the toner T (the toner T that is borne on the developing roller 510). The developing roller 510 is a member made of an aluminum alloy or iron alloy or the like. The developing roller 510 includes the projecting sections 512 and non-projecting sections 513 on a surface of its central area 510*a*, and the non-projecting sections 513 are provided with lateral sections 514 and the depressed sections 515. As shown in FIG. 5 to FIG. 7, these are arranged regularly on the surface of the developing roller 510. It should be noted that in the present embodiment, each of the projecting sections 512 and the non-projecting sections 513 (the lateral sections 514 and the depressed sections 515) functions as a toner bearing member for bearing the toner T. And the developing roller 510 develops the latent image that is borne on the photoconductor 20 using the toner T borne on the projecting sections 512, the lateral sections 514, and the depressed sections 515.

The projecting sections 512 are the highest area within the central area 510*a*, and are a top surface in a square planar shape as shown in the upper diagram of FIG. 7. A length L1 of one side of the square projecting sections 512 (see lower diagram in FIG. 7) is approximately 50 μm. The two diagonals of the square shapes of the projecting sections 512 are formed on the surface of the central area 510*a* so as to align along a rotation-axis direction and a circumferential direction of the developing roller 510 respectively.

In the present embodiment, the non-projecting sections 513 are constituted by a first groove portion 516 and a second groove portion 518 that wind around the developing roller in different directions. Here, the first groove portion 516 is a spiral groove whose longitudinal direction runs along a direction shown by symbol X in FIG. 6, and the second groove portion 518 is a spiral groove whose longitudinal direction runs along a direction shown by symbol Y in FIG. 6. Thus, the first groove portions 516 and the second groove portions 518 intersect each other to form a grid shape and the projecting sections 512 are surrounded by the first groove portions 516 and the second groove portions 518. It should be noted in regard to both the groove portions that the acute angles formed by their longitudinal direction and the rotation-axis direction of the developing roller 510 are approximately 45 degrees (see FIG. 6). Furthermore, a groove width L2 of the groove portions (in other words, the distance between projecting sections 512 adjacent to each other, see the lower diagram in FIG. 7) is equivalent to the length L1 of one side of the projecting sections 512, which is approximately 50 μm.

The lateral sections 514 are slanted surfaces connecting the projecting sections 512 and the depressed sections 515, and as shown in the upper diagram of FIG. 7, four lateral sections 514 are provided in correspondence with the four sides of the above-described square projecting sections 512. And as shown in FIG. 5 to FIG. 7, many instances of (groups of) the protrusion 512 and the four lateral sections 514 are arranged regularly in a meshed manner on the surface of the central area 510*a* of the developing roller 510.

The depressed sections 515 correspond to the bottom portions of the non-projecting sections 513 (namely, the first groove portions 516 and the second groove portion 518), and are the lowest areas of the central area 510*a*. As shown in FIG. 5 to FIG. 7, the depressed sections 515 are formed regularly in a meshed manner surrounding the projecting sections 512 and the four lateral sections 514 on all four sides. It should be noted that, as shown in FIG. 7, a depth d of the depressed sections 515 (the non-projecting sections 513) with reference to the projecting sections 512 (a length from the projecting sections 512 to the depressed sections 515 in the diameter direction of the developing roller 510) is approximately 8 μm. In the developing roller 510, the projecting sections 512 and the depressed sections 515 are formed so that the depth d is uniform between all the depressed sections 515 provided in the developing roller 510. In the present embodiment, the toner T is granular (particulate) and the volume mean particle size of the toner T is approximately 4.6 μm, and therefore the size of the volume mean particle size of the toner T is smaller than the depth d of the depressed sections 515.

Further still, the surface of the central area 510*a*, which is provided with the above-described projecting sections 512, lateral sections 514, and depressed sections 515, is subjected to electroless Ni—P plating.

Furthermore, the developing roller 510 is provided with a shaft section 510*b*, and the developing roller 510 is rotatably supported as a result of the shaft section 510*b* being supported via bearings 576 with developing roller supporting sections 526*b* of the holder 526, which are described later (FIG. 11). As shown in FIG. 4, the developing roller 510 rotates in a direction (the counterclockwise direction in FIG. 4) that is opposite to the rotating direction of the photoconductor 20 (the clockwise direction in FIG. 4).

Moreover, in the state in which the yellow developing device 54 opposes the photoconductor 20, there is a gap between the developing roller 510 and the photoconductor 20. That is, the yellow developing device 54 develops the latent image that has been formed on the photoconductor 20 in a non-contact state in which the toner T borne on the developing roller 510 is not contacting the photoconductor 20.

The housing 540 is manufactured by welding together a plurality of integrally-molded housing sections made of resin, namely, an upper housing section 542 and a lower housing section 544. A toner containing member 530 for containing toner T is formed inside the housing 540. The toner containing member 530 is divided by a partitioning wall 545 for partitioning the toner T, which protrudes inwards (in the vertical direction of FIG. 4) from the inner wall, into two toner containing sections, namely, a first toner containing section 530*a* and a second toner containing section 530*b*. The first toner containing section 530*a* and the second toner containing section 530*b* are in communication at the upper sections, and in the state shown in FIG. 4, the movement of toner T is regulated by the partitioning wall 545. Moreover, as shown in FIG. 4, the housing 540 (that is, the first toner containing section 530*a*) has an opening 572 at its lower section, and the developing roller 510 is arranged so that it faces this opening 572.

The toner supply roller 550 is disposed on the above-mentioned first toner containing section 530*a* and supplies the toner T contained in the first toner containing section 530*a* to the developing roller 510. The toner supply roller 550 is made of polyurethane foam, for example, and comes into contact with the developing roller 510 in an elastically deformed state. The toner supply roller 550 is rotatable around its center axis, and by rotating, it transports the toner T to the contact position where it comes into contact with the developing roller 510. Then, at the contact position, the toner T is frictionally charged due to the toner supply roller 550 and the developing roller 510, and the thus-charged toner T adheres to the developing roller 510 and is appropriately borne on the developing roller 510. In this manner, the toner supply roller 550 supplies the toner T to the developing roller 510.

It should be noted that the toner supply roller 550 rotates in a direction (the clockwise direction in FIG. 4) that is opposite the rotating direction of the developing roller 510 (the counterclockwise direction in FIG. 4). Furthermore, the toner supply roller 550 not only has the function to supply the toner T to the developing roller 510, but also the function to scrape off the toner T that has remained on the developing roller 510 after the development from the developing roller 510.

The upper seal 520, which comes into contact with the developing roller 510 along its rotation-axis direction, allows the movement of toner T that has remained on the developing roller 510 after passing the developing position into the housing 540 and restricts the movement of toner T inside the housing 540 from moving out of the housing 540. This upper seal 520 is a seal made of polyethylene film or the like. The upper seal 520 is supported by an upper seal supporting section 526*a* of the holder 526 described later, and is disposed so that its longitudinal direction runs along the rotation-axis direction of the developing roller 510 (FIG. 11).

Furthermore, an upper seal urging member 524 made of an elastic member such as Moltopren is provided in a compressed state between the upper seal support section 526*a* and the surface of the upper seal 520 that is on the opposite side to a contact surface 520*b* contacting the developing roller 510 (this surface is also referred to as "opposite surface 520*c*"). The upper seal urging member 524 presses the upper seal 520 against the developing roller 510 by urging the upper seal 520 toward the developing roller 510 with its urging force.

The regulation blade 560 comes into contact with the developing roller 510 at a contact section 560*a* so that the longitudinal direction of the regulation blade 560 runs along the rotation-axis direction of the developing roller 510 from one end portion to the other end portion in the rotation-axis direction of the developing roller 510, and regulates the amount of the toner T borne on the developing roller 510 (the projecting sections 512 and the non-projecting sections 513), and moreover, it applies a charge to the toner T borne on the developing roller 510.

The regulation blade 560 is constituted by a silicone rubber or a urethane rubber or the like, which are examples of a rubber elastic body, and as shown in FIG. 4 and FIG. 8, it is supported by the blade-supporting member 564. The blade-supporting member 564 is made of a thin plate 564*a* and a thin-plate supporting section 564*b*, and supports the regulation blade 560 at its one end 564*d* in its lateral direction (that is, at the end on the side of the thin plate 564*a*). The thin plate 564*a* is made of phosphor bronze or stainless steel or the like and has spring properties. The thin plate 564*a* directly supports the regulation blade 560 and presses the regulation blade 560 with its urging force against the developing roller 510. The thin-plate supporting section 564*b* is a metal plate that is arranged on the other end 564*e* in the lateral direction of the blade-supporting member 564, and this thin-plate supporting section 564*b* is attached to the thin plate 564*a* in a state in which it is supported at the end of the thin plate 564*a* that is opposite from the side that supports the regulation blade 560. The regulation blade 560 and the blade-supporting member 564 are attached to a regulation blade support sections 526*c* with longitudinal direction end portions 564*c* of the thin-plate supporting section 564*b* being supported by the regulation blade support sections 526*c* of the holder 526 described later.

Furthermore, as shown in FIG. 9, the regulation blade 560 is disposed so that its leading edge 560*b* in the lateral direction and thickness direction of the regulation blade 560 faces the upstream side of the developing roller 510 in the rotating direction. That is, the regulation blade 560 is in so-called counter contact.

Furthermore, as shown in FIG. 9, the leading edge 560*b* does not come into contact with the developing roller 510, and the contact section 560*a* that comes into contact with the developing roller 510 is positioned at a position apart from the leading edge 560*b*. Further still, in the present embodiment, a distance g from the leading edge 560*b* to the projecting sections 512 in the case where the leading edge 560*b* is in opposition to the projecting sections 512 among the projecting sections 512 and the depressed sections 515 of the rotating developing roller 510 (FIG. 9 shows this state, that is, a state in which the developing roller 510 rotates and the leading edge 560*b* becomes in opposition to the projecting sections 512, and the area in opposition to the top of the projecting sections 512 is indicated with the symbol 512*a*) is extremely small (in other words, when a virtual line is drawn from the leading edge 560*b* toward the cross-sectional center of the developing roller 510 shown in FIG. 4 with the symbol C, the distance g corresponds to a length of the virtual line from an intersection of the virtual line and the projecting sections 512 to the leading edge 560*b*). More specifically, the distance g is approximately 2 μm, which is a value smaller than the volume mean particle size of the toner T (approximately 4.6 μm).

Furthermore, as shown in FIG. 11, end seals 574 are provided on the outer sides in the longitudinal direction of the regulation blade 560. The end seals 574 are made of non-woven fabric, and contact the developing roller 510 along the circumferential surface thereof at the end portions in the rotation-axis direction thereof along the circumferential surface thereof, so as to perform a function to prevent leakage of the toner T from a space between the circumferential surface and the housing 540.

The holder 526 is a metal member on which various members such as the developing roller 510 are assembled. As shown in FIG. 10, it includes the upper seal support section 526*a* disposed along the longitudinal direction of the holder 526 (namely, the rotation-axis direction of the developing roller 510), the developing roller support sections 526*b* that are provided on the outside in the longitudinal direction (the rotation-axis direction) of the upper seal support section 526*a* and intersect the longitudinal direction (the rotation-axis direction), and the regulation blade support sections 526*c* that intersect the developing roller support sections 526*b* and face the end portion in the longitudinal direction of the upper seal support section 526*a*.

As shown in FIG. 11, the upper seal 520 is supported by the upper seal support section 526*a* at a lateral direction end portion 520*a* thereof (FIG. 4), and the developing roller 510 is supported by the developing roller support sections 526*b* at its ends. Further still, the regulation blade 560 and the blade-supporting member 564 are supported by the regulation blade support sections 526*c* at the longitudinal direction end portions 564*c* of the blade-supporting member 564. The regulation blade 560 and the blade-supporting member 564 are secured to the holder 526 by being screwed into the regulation blade support sections 526*c*. In this manner, the holder 526 on which the upper seal 520, the developing roller 510, the regulation blade 560, and the blade-supporting member 564 are attached in an assembled manner, is attached to the above-described housing 540 via a housing seal 546 (FIG. 4) for preventing leakage of the toner T from between the holder 526 and the housing 540, as shown in FIG. 12.

In the yellow developing device 54 configured in this manner, the toner supply roller 550 supplies the toner T contained in the toner container 530 to the developing roller 510. During supply the toner T is frictionally charged due to the toner supply roller 550 and the developing roller 510, and the thus-charged toner T adheres to the developing roller 510 and is appropriately borne on the developing roller 510. The toner T borne on the developing roller 510 reaches the regulation blade 560 along with rotation of the developing roller 510, then the amount of the toner T is regulated by the regulation blade 560 and the toner T is further frictionally charged. The toner T on developing roller 510 is brought to the developing position in opposition to the photoconductor 20 due to further rotation of the developing roller 510, and is supplied for developing the latent image formed on the photoconductor 20 in an alternating electric field at the developing position. The toner T on the developing roller 510 that has passed the developing position due to further rotation of the developing roller 510 passes the upper seal 520 and is collected in the developing device without being scraped off by the upper seal 520. Moreover, the toner T that is still remaining on the developing roller 510 is scraped off by the toner supply roller 550.

Mechanism of Development Memory Occurrences

Figure 13:
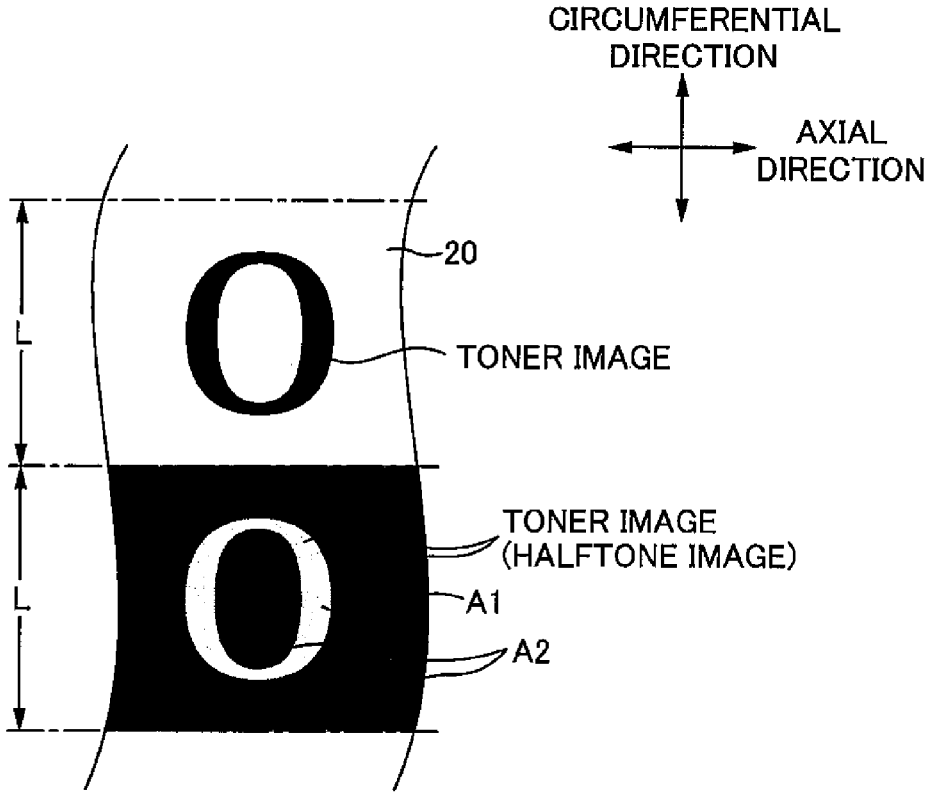
FIG. 13 is an explanatory diagram for describing a mechanism of development memory occurrences.

As described in the section "Problems to be Solved by the Invention", in the case where toner having a slow charge buildup (toner that takes time for its charging amount to reach a saturated charge amount) is used in the printer 10, a phenomenon known as a so-called development memory can occur due to the slowness of the charge build-up. Here, description is given regarding a mechanism of development memory occurrences using FIG. 13. FIG. 13 is an explanatory diagram for describing a mechanism of development memory occurrences.

As described earlier, the toner is frictionally charged due to the toner supply roller 550 and the developing roller 510, and the thus-charged toner adheres to the developing roller 510 and is borne on the developing roller 510. Then, the toner borne on the developing roller 510 reaches the developing position that opposes the photoconductor 20 after being further frictionally charged by the regulation blade 560, and is supplied for the development of the latent image at the developing position. That is, the following processes that are executed when the developing roller 510 performs one revolution, namely a process of charging and supplying toner using the toner supply roller 550 (causing toner to be borne on the developing roller 510), a process of charging the toner using the regulation blade 560, and a process of developing the latent image on the photoconductor 20, are executed a plurality of times by the developing roller 510 performing a plurality of revolutions. Then, for example, a toner image formed on the photoconductor 20 by executing the aforementioned series of processes in an n-th revolution of the developing roller 510, and a toner image formed on the photoconductor 20 by executing the aforementioned series of processes in an (n+1)-th revolution of the developing roller 510, become lined up in the circumferential direction of the photoconductor 20.

Here, in the present section we will examine the aforementioned processing of the developing roller 510 in a case involving a latent image expressing the alphabet letter "O" being developed and a toner image expressing the alphabet letter "O" being formed on the photoconductor 20 by executing the aforementioned series of processes in the n-th revolution of the developing roller 510, and a halftone image being formed on an entire surface of the photoconductor 20 by developing a latent image as a result of executing the aforementioned series of processes in the (n+1)-th revolution of the developing roller 510. And by examining this, a mechanism of development memory occurrences will be clarified.

When developing the latent image that expresses the alphabet letter "O" in the aforementioned development processing in the n-th revolution of the developing roller 510, of the toner borne on the developing roller 510, it is the toner borne on the developing roller 510 in the portions facing the latent image that is consumed so as to form a toner image. For this reason, after the completion of the development processing in the n-th revolution of the developing roller 510, this facing portion no longer bears toner. On the other hand, toner that is borne on the developing roller 510 in portions not facing the latent image are not consumed, and therefore toner is still borne on these non-facing portions after the completion of the development processing. When the aforementioned series of processes in the n-th revolution of the developing roller 510 finishes in this manner, a first region in which toner is not borne (this first region is shaped as the letter "O") and a second region in which toner is borne are produced on the developing roller 510.

Then, due to the developing roller 510 rotating, the first region and the second region eventually reach the contact position that is in contact with the toner supply roller 550, and the aforementioned series of processes in the (n+1)-th revolution of the developing roller 510 commences. In other words, at the contact position, the process of charging and supplying toner is executed using the (n+1)-th revolution of the toner supply roller 550.

Here, toner is already borne on the second region, and this toner is in a sufficiently charged state due to the execution of the process of charging and supplying toner using the toner supply roller 550 in the n-th revolution and the process of charging the toner using the regulation blade 560 in the n-th revolution. Then, (without being scraped off by the toner supply roller 550) this toner is even further charged by executing this processing, and therefore the adhesiveness by which the toner adheres to the developing roller 510 is further increased. Consequently, while continuing to be borne on the developing roller 510, this toner is transported toward the regulation blade 560 so as to execute the next processing.

On the other hand, since toner is not borne on the first region, toner that is contained in the toner container 530 is freshly supplied to the first region. The toner here is different from the second region toner, which is sufficiently charged due to the execution of the toner charging process in the n-th revolution, and its charge is insufficient. Then, in this processing, the toner is frictionally charged by the toner supply roller 550 and the developing roller 510, but in the case where the toner has a property of a slow charge build-up (where it takes time for the charging amount of the toner to reach a saturated charge amount), toner will not be appropriately borne on the developing roller 510 during the frictional charging (it can also be said that the supply of toner by the toner supply roller 550 in the first region is not executed sufficiently).

Then, the first region, in which toner is not appropriately borne on, and the second region, in which toner is being appropriately borne on, reach the regulation blade 560 so as to execute the process of charging the toner using the regulation blade 560 in the (n+1)-th revolution, after which they arrive at the developing position facing the photoconductor 20. Here, a halftone image is formed on the entire surface of the photoconductor 20 by executing the development processing of the (n+1)-th revolution and developing the latent image, but although the toner is borne appropriately on the second region, the toner is not borne appropriately on the first region, and therefore the density of the halftone image formed by developing the latent image facing the first region is lighter than the density of the halftone image formed by developing the latent image facing the second region.

This condition (a difference between the two densities) is shown in FIG. 13. FIG. 13 shows a toner image expressing the alphabet letter "O" formed on the photoconductor 20 by executing the aforementioned series of processes in the n-th revolution of the developing roller 510, and a halftone image formed on the photoconductor 20 by executing the aforementioned series of processes in the (n+1)-th revolution of the developing roller 510. In FIG. 13, the toner images formed on the photoconductor 20 are shown on the circumferential surface of the photoconductor 20, which is schematically extended, and the circumferential direction and the axial direction of the photoconductor 20 are indicated with arrows. The length L indicated in FIG. 13 corresponds to a length of one revolution of the circumferential surface of the developing roller 510.

And FIG. 13 shows a condition in which the density of the halftone image formed by developing the latent image facing the first region (indicated in FIG. 13 with the reference symbol A1) is lighter than the density of the halftone image formed by developing the latent image facing the second region (indicated in FIG. 13 with the reference symbol A2). Also, since the first region is shaped as the letter "O" as mentioned earlier, the lighter density halftone image that is formed by developing the latent image facing the first region is also shaped as the letter "O". That is, a phenomenon, namely, development memory, occurs in which a form of the toner image, which has been formed on the photoconductor 20 by executing the aforementioned series of processes in the n-th revolution, appears on the halftone image that is formed on the photoconductor 20 by executing the aforementioned series of processes in the (n+1)-th revolution.

In the case where toner having a slow charge build-up is used in the printer 10 in this manner, development memory caused by this slowness of the charge build-up can occur conspicuously.

Conversely, in the case where toner having a fast charge build-up is used, toner is appropriately borne on the developing roller 510 in the first region also while the toner is frictionally charged by the toner supply roller 550 and the developing roller 510 in the process of charging and supplying toner in the (n+1)-th revolution, and therefore the density of the halftone image formed by developing the latent image facing the first region and the density of the halftone image formed by developing the latent image facing the second region are substantially equivalent. Thus, in this case, occurrences of development memory are inhibited.

Regarding the Toner Structure According to the Present Embodiment and the Relationship between the Toner Structure and Extent of Development Memory Occurrences As mentioned earlier, in the case where toner having a slow charge build-up is used in the printer 10, development memory caused by this slowness of the charge build-up can occur conspicuously. And since the speed of the toner charge build-up is linked to the structure of the toner, there is a regular relationship between the toner structure and the extent of development memory occurrences.

Here, description is given first regarding the structure of the toner according to this embodiment, that is, the toner used in the printer 10 according to the present embodiment. Then, following this, the relationship between the structure of the toner according to the present embodiment and the extent of development memory occurrences is examined.

Regarding the Structure of Toner According to the Present Embodiment

1) Regarding Toner Particle Size

In regard to the toner used in the printer 10 according to this embodiment, in giving importance to achieving excellent image quality for the images to be finally obtained (improving dot reproducibility), the toner particle size is set smaller than the toner particle size (larger than a volume mean particle size of 5 μm) that has been used in general conventionally (that is, the volume mean particle size here is not greater than 5 μm). More specifically, as mentioned earlier, its volume mean particle size Ave is approximately 4.6 μm. Furthermore, a 3σ value, namely a value obtained by subtracting 3 times a standard deviation σ in the toner particle size distribution from the volume mean particle size Ave, and a value obtained by adding 3 times the standard deviation σ in the toner particle size distribution to the volume mean particle size are approximately 2.3 μm and approximately 6.9 μm respectively.

It should be noted that the volume mean particle size is a value calculated by a sum total of the products of Ri and Pi from i=1 to n under a condition in which volume occupation rates of toner of particle sizes Ri (i=1 to n) are respectively Pi (i=1 to n, the sum total from P1 to Pn is 1). Furthermore, the standard deviation σ is a square root of dispersion, and the dispersion is a value calculated by a sum total of the products of the square values of a difference between Ri (i=1 to n) and Ave, and Pi from i=1 to n.

2) Regarding the Degree of Circularity of the Toner

In giving importance to transferability in first transferring and secondary transferring for the toner used in the printer 10 according to this embodiment, the degree of circularity of the toner is greater (approaching a perfect circle, and where the degree of circularity is not less than 0.950) than the degree of circularity of toner that is used in general conventionally (where the degree of circularity is less than 0.950). More specifically, the degree of circularity is approximately 0.960 to 0.985.

3) Regarding the Charge Control Agent (CCA)

The toner used in the printer 10 according to this embodiment does not contain a charge control agent (CCA).

Typical toner manufacturing methods include pulverization techniques and polymerization techniques, but since the polymerization techniques are more suited to the manufacture of small particle size toner and to the manufacture of toner having a high degree of circularity, the toner according to the present embodiment is manufactured using a polymerization technique. And since there is a possibility of difficulties occurring if a charge control agent (CCA) is included in the case where a polymerization technique is used as the toner manufacturing method, in this embodiment, the toner does not contain a charge control agent (CCA).

It should be noted that examples of polymerization techniques that can be put forth include suspension polymerization and emulsion polymerization. In the suspension polymerization technique, a colored toner particle (core particle) having a desired particle size can be formed by adding while agitating a monomer composite, in which a polymerizable monomer, a coloring agent (coloring pigment), a release agent, and further as required, a dye, a polymerization initiator, a cross-linking agent, and other additives have been dissolved or dispersed, to an aqueous phase containing a suspension stabilizer (a water-soluble macromolecule and a poorly water-soluble inorganic substance), then causing granulation and polymerization. In the emulsion polymerization technique, a coloring toner particle (core particle) having a desired particle size can be formed by dispersing a monomer and a release agent, and further as required, a polymerization initiator, an emulsifying agent (a surface-active agent) or the like, in water and carrying out polymerization, then adding a coloring agent (coloring pigment) and an agglutination agent (an electrolyte) or the like in an agglutination process.

The toner according to this embodiment is manufactured using an emulsion polymerization technique, and hereinafter description is given regarding a manufacturing method based on an emulsion polymerization technique for the cyan toner of the aforementioned toners of four colors (black toner, magenta toner, cyan toner, and yellow toner).

First, a monomer mixture, which is constituted by 80 parts by mass styrene monomer, which is a monomer, 20 parts by mass butyl acrylate, and 5 parts by mass acrylic acid, is added to an aqueous mixture of 105 parts by mass water, 1 part by mass nonionic emulsifying agent (Emulgen 950 produced by Dai-ichi Kogyo Seiyaku), 1.5 parts by mass anionic emulsifying agent (Neogen R produced by Dai-ichi Kogyo Seiyaku), and 0.55 parts by mass potassium persulfate, which is a polymerization initiator, then, while this is agitated in a nitrogen gas stream, it is subjected to polymerization for 8 hours at 70° C. Cooling is performed after the polymerization reaction, thereby obtaining a milk-white resin emulsion having a particle size of 0.25 μm.

Next, 200 parts by mass of the resin emulsion, 20 parts by mass of a polyethylene wax emulsion (produced by Sanyo Chemical Industries Ltd.), which is a release agent, and 25 parts by mass phthalocyanine blue, which is a coloring agent, are dispersed into 0.2 liters of water containing 0.2 parts by mass sodium dodecylbenzenesulfonate, which is a surface-active agent, then diethylamine is added and the pH is adjusted to 5.5, after which 0.3 parts by mass aluminum sulfate, which is an electrolyte, is added while agitating the mixture, and following this, dispersion is carried out by performing high speed agitation using an agitation device (T.K. HOMO Mixer).

Further still, 40 parts by mass styrene monomer, 10 parts by mass butyl acrylate, and 5 parts by mass zinc salicylate are added along with 40 parts by mass water, and this is heated to 90° C. in a similar manner while being agitated in a nitrogen gas stream, then hydrogen peroxide water is added and polymerization is performed for 3 hours, thereby growing the particles. After polymerization has stopped, the temperature is raised to 95° C. while adjusting the pH to 5 or greater and held there for 5 hours so as to increase the bond strength of the associating particles. After this, the particles obtained are rinsed then subjected to vacuum drying for 10 hours at 45° C., thereby obtaining a cyan toner core particle (coloring toner particle).

By admixing the thus-obtained coloring toner particle and an external additive (specifically, silica and titania, which are described later), the external additive becomes externally added to the coloring toner particle, and thus obtaining a cyan toner having a volume mean particle size of 4.6 μm.

4) Regarding the Coloring Agent (Coloring Pigment)

Taking into account that the particle size of the toner is small for the toner used in the printer 10 according to this embodiment, the amount of coloring agent (coloring pigment) contained in the toner is greater (namely, not less than 10 wt %) than the amount of coloring agent (coloring pigment) contained in toner that is used in general conventionally (which is less than 10 wt %). That is, in the case where the toner particle size is small, the amount of toner that finally adheres to the medium such as paper is small, and therefore there is a tendency for the density of the image to become lighter. Accordingly, more coloring agent (coloring pigment) is included in the present embodiment in order to compensate for this.

Regarding the Relationship between the Toner Structure and Extent of Development Memory Occurrences The toner according to this embodiment has properties that were described in numbered sections 1 to 4 above. And due to the toner having these properties, development memory tends to occur easily in the printer 10 according to the present embodiment in which this toner is used.

That is, when the toner particle size becomes smaller, the saturated charge amount of the toner becomes higher, and therefore the toner charge build-up becomes slower. Furthermore, since the toner does not contain a charge control agent (CCA), charge control for increasing the speed of the toner charge build-up cannot be implemented. Furthermore, the toner charge build-up will be slow regardless since there is a large amount of coloring agent (coloring pigment).

Thus, in the printer 10 according to this embodiment, the toner charge build-up is slow, and therefore development memory tends to occur easily.

Also, in the case where the degree of circularity of the toner is small, the toner more easily sticks to the developing roller 510, and therefore even if the toner charge build-up is slow, the aforementioned inappropriateness relating to bearing of toner in the first region is slightly alleviated. For this reason, the difference between the density of the halftone image formed by developing the latent image facing the first region and the density of the halftone image formed by developing the latent image facing the second region becomes very small, thereby somewhat inhibiting occurrences of development memory. However, this can not be expected to help in this situation since the toner according to the present embodiment has a high degree of circularity and consequently occurrences of development memory become more conspicuous in this embodiment.

Overview of the External Additive

Next, description is given regarding an overview of the external additive that is externally added to the core particle of the toner.

External additives are externally added to the core particles mainly with an object of improving fluidity of the toner and charge stabilization. In the present embodiment, four types of external additives are externally added to the core particle (coloring toner particle). The four types of external additives are external additives having different volume mean particle sizes respectively, specifically, a silica having a volume mean particle size of 15 nm (nanometers) (hereinafter also referred to as 15 nm silica), a titania having a volume mean particle size of 30 nm, a silica having a volume mean particle size of 50 nm (hereinafter also referred to as 50 nm silica), and a silica having a volume mean particle size of 500 nm (hereinafter also referred to as 500 nm silica). And an amount (externally added amount) of the 15 nm silica that is externally added to the core particle is 1.0 wt %, the externally added amount of titania is 1.0 wt %, the externally added amount of 50 nm silica is 1.0 wt %, and the externally added amount of the 500 nm silica is 0.5 wt %.

The four types of external additives are externally added to the core particles by being admixed with the core particles, in a mixing vat such as a Henschel mixer. A stirring blade or the like is arranged in the mixing vat to admix the core particles and the external additives, and the external additives are externally added to the core particles by rotating the stirring blade for a predetermined time only. In this embodiment, the four types of external additives are admixed to the core particles in the following sequence. Initially, the 50 nm silica (1.0 wt %) is injected to the mixing vat and is admixed with the core particles for 20 seconds (that is, the stirring blade is rotated for 20 seconds). Next, the 15 nm silica (1.5 wt %) and the titania (1.0 wt %) are injected to the mixing vat and admixed for a further 30 seconds (during this 30 seconds, the previously injected 50 nm silica is also admixed). Finally, the 500 nm silica (0.5 wt %) is injected to the mixing vat and admixed for a further 10 seconds.

In regard to toner having external additives that are externally added to the core particles, sometimes the external additives separate from the core particles during usage of the developing devices 51, 52, 53, and 54. And separation of the external additives from the core particles tends to occur more easily for external additives having larger volume mean particle sizes. Thus, of the four types of external additives, the 500 nm silica, which has the largest volume mean particle size, tends to separate easily. Furthermore, separation of the external additives from the core particles also has a relationship with the mixing time of the external additives and the core particles in the mixing vat, and external additives having shorter mixing times tend to separate more easily from the core particles. And as mentioned earlier, it is the 500 nm silica of the four types of external additives that is last to be admixed with the core particles and its mixing time is also shorter compared to the mixing times of the other external additives. For this reason, compared to the other external additives, the 500 nm silica tends to separate more easily from the core particles.

Inhibiting Effect on Development Memory Due to Regulation State of Regulation Blade 560

As shown in FIG. 9, the regulation state of the regulation blade 560 according to this embodiment is set so that the leading edge 560*b* of the regulation blade 560 faces the upstream side in the rotating direction of the developing roller 510, and so that a distance g (approximately 2 μm) from the leading edge 560*b* to the projecting sections 512 at the time the leading edge 560*b* faces the projecting sections 512 of the developing roller 510 is smaller than the toner volume mean particle size (approximately 4.6 μm). In this way, occurrences of the aforementioned development memory can be effectively inhibited. This point is described in greater detail below.

As described earlier, the toner that is frictionally charged by the toner supply roller 550 and the developing roller 510 and that is borne on the developing roller 510 reaches the regulation blade 560 along with rotation of the developing roller 510, then the amount of the toner is regulated by the regulation blade 560 and the toner is further frictionally charged.

Here, in the case where the distance g (approximately 2 μm) is smaller than the toner volume mean particle size (approximately 4.6 μm), in the case where the toner that has been borne on the projecting sections 512 of the developing roller 510 has reached the regulation blade 560 in accordance with rotation of the developing roller 510, the toner that is borne on the projecting sections 512 having this volume mean particle size is unable to pass through the (2 μm) gap between the leading edge 560*b* and the opposing area 512*a* (rebounds after hitting the leading edge 560*b*), and cannot reach the developing position facing the photoconductor 20.

On the other hand, when focusing on the toner borne on the depressed sections 515, the toner volume mean particle size (approximately 4.6 μm) is smaller than the depth d of the depressed sections 515 (approximately 8 μm), and therefore the toner that is borne on the depressed sections 515 and has this volume mean particle size is able to pass through the (2 μm) gap between the leading edge 560*b* and the opposing area 512*a* and reaches the developing position facing the photoconductor 20.

As a result, the condition of the toner borne on the projecting sections 512 and the depressed sections 515 at the developing position facing the photoconductor 20 is as follows. Namely, the extremely small particle size toner (the amount of this toner is small) that was able to pass through the (2 μm) gap between the leading edge 560*b* and the opposing area 512*a* is borne on the projecting sections 512. On the other hand, toner of various particle sizes (mainly toner having the above-described volume mean particle sizes) is borne on the depressed sections 515. And a large amount of toner is borne on the depressed sections 515 so that the entirety of the depressed sections 515 is covered.

Next, description is given regarding why occurrences of development memory are inhibited and deterioration of image quality of images is appropriately prevented when the regulation blade 560 performs regulation as described above.

In the first region where toner is not being borne, which occurs when the development processing of the n-th revolution of the developing roller 510 has finished, toner contained in the toner container 530 is freshly supplied in the process of charging and supplying toner using the toner supply roller 550 in the (n+1)-th revolution. And description has been given regarding a point above that in the case where the toner freshly supplied to the first region is toner having a property of being a toner whose charge build-up is slow, the toner will not be borne appropriately on the first region of the developing roller 510 in the case where frictional charging has been carried out by the toner supply roller 550 and the developing roller 510.

Here, the projecting sections 512 and the depressed sections 515 are present within the first region, but the extent of inappropriateness relating to bearing of toner in the first region varies depending on which among the projecting sections 512 and the depressed sections 515 of the first region the toner is borne on. That is, the non-projecting sections 513 including the depressed sections 515 are cupped so as to easily accommodate toner, and therefore toner readily enters the non-projecting sections 513. And the toner that has entered the non-projecting sections 513 is subjected to packing within the non-projecting sections 513, and an agglutinative force produced at this time provides an effect of bearing the toner in the depressed sections 515. Consequently, in the depressed sections 515, even if the toner charge build-up is slow, the aforementioned inappropriateness relating to bearing of toner in the first region is alleviated. In contrast to this, this effect is not obtained for the projecting sections 512, and the extent of inappropriateness is smaller in the depressed sections 515 than the projecting sections 512.

For this reason, during the development processing of the (n+1)-th revolution, a difference between the density of the halftone image formed by developing the latent image facing the depressed sections 515 of the first region and the density of the halftone image formed by developing the latent image facing the depressed sections 515 of the second region is smaller than a difference between the density of the halftone image formed by developing the latent image facing the projecting sections 512 of the first region and the density of the halftone image formed by developing the latent image facing the projecting sections 512 of the second region. In other words, in inhibiting occurrences of development memory, it is better to as much as possible develop the latent image using toner borne on the depressed sections 515, of the projecting sections 512 and the depressed sections 515.

In light of these facts, in this embodiment, the distance g is smaller than the volume mean particle size of the toner (approximately 4.6 nm). In this way, as described above, at the developing position, in contrast to the slight amount of toner borne on the projecting sections 512, a large amount of toner is borne on the depressed sections 515. And by developing the latent image under these conditions, the difference between the density of the halftone image formed by developing the latent image facing the first region and the density of the halftone image formed by developing the latent image facing the second region becomes very small compared to a case where for example the latent image is developed in a condition in which the amount of toner borne on the projecting sections 512 is equivalent to the amount of toner borne on the depressed sections 515. As a result, occurrences of development memory can be inhibited and deterioration in image quality of the finally obtained image is appropriately prevented.

Regarding Unusual Sounds Produced Between the Developing Roller 510 and the Regulation Blade 560

As described earlier, the regulation blade 560 comes into contact with the contact section 560*a* at the surface of the developing roller 510 that rotates. In this regard, there is a risk that the contact section 560*a* will adhere closely to the projecting sections 512 when it comes into contact with projecting sections 512 that are not bearing toner. And when the developing roller 510 further rotates while the contact section 560*a* is closely adhering to the projecting sections 512, there is a risk that problems such as unusual sounds will be produced. In particular, in the case where the distance g is smaller than the toner volume mean particle size, unusual sounds, which are described later, tend to be more easily produced.

To address these problems, in the printer 10 according to this embodiment, a relationship among sizes of the volume mean particle size of the external additives constituting the toner (hereinafter also referred to as external additive particle size B), a ten-point average roughness Rz of the projecting sections 512 (hereinafter also referred to as protrusion roughness C), and the distance g from the leading edge 560*b* to the projecting sections 512 at the time the leading edge 560*b* faces the projecting sections 512 (hereinafter also referred to as distance D) is set so that the protrusion roughness C<the external additive particle size B<the distance D (note that below the toner volume mean particle size is also referred to as toner particle size A).

Hereinafter, first description is given regarding a mechanism by which unusual sound is produced between the contact section 560*a* and the projecting sections 512 in the case where the distance g is smaller than the toner volume mean particle size, and following this description is given regarding why occurrences of unusual sounds are inhibited when a relationship of the protrusion roughness C<the external additive particle size B<the distance D is implemented.

Mechanism Producing Unusual Sounds

As described above, the amount of toner borne on the projecting sections 512 is very small in the case where the distance g (approximately 2 μm) is smaller than the toner volume mean particle size (approximately 4.6 μm) (namely, where there is a relationship of distance D<the toner particle size A).

Figure 14:
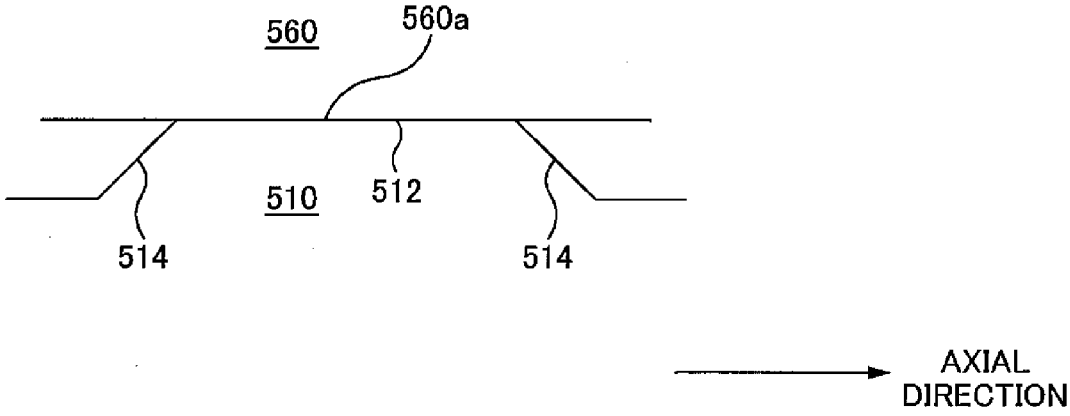
FIG. 14 is a schematic diagram for describing a condition in which the contact section 560*a* comes into direct contact with the projecting sections 512 without toner being interposed therebetween.

And in the case where the a very small amount of toner is borne on the projecting sections 512, the contact section 560*a* comes into direct contact with the projecting sections 512 where toner is not being borne on as shown in FIG. 14. Here, the projecting sections 512 are the top surface (in FIG. 14 the top surface is a border surface), and the contact section 560*a* is configured to contact the protrusion 512 along its width, and therefore when the contact section 560*a* comes into direct contact with the projecting sections 512, the contact section 560*a* sometimes adheres closely to the projecting sections 512. In particular, since the regulation blade 560 is a urethane rubber or the like, the surface area of the contact section 560*a* that comes into contact with the projecting sections 512 tends to be large due to the contact section 560*a* undergoing elastic deformation to come into contact with the projecting sections 512, and the contact section 560*a* tends to adhere closely to the projecting sections 512. And when the developing roller 510 further rotates (moves the projecting sections 512) from the state shown in FIG. 14 (a state in which the contact section 560*a* is closely adhering to the projecting sections 512), there is a risk that an unusual sound will be produced between the contact section 560*a* and the projecting sections 512 during this rotation. It should be noted that FIG. 14 is a schematic diagram for describing a condition in which the contact section 560*a* comes into direct contact with the projecting sections 512 without toner being interposed therebetween.

It should be noted that in the case where the contact section 560*a* adheres closely to the projecting sections 512, there is not only the aforementioned unusual sounds, but there is also a problem in that the torque required for rotating the developing roller 510 greatly increases.

Advantages of the Developing device According to the Present Embodiment

In contrast to this, the developing devices 51, 52, 53, and 54 according to this embodiment are configured such that a relationship among the volume mean particle size of the external additives (external additive particle size B), a ten-point average roughness Rz of the projecting sections 512 (protrusion roughness C), and the distance g (distance D) is the protrusion roughness C<the external additive particle size B<the distance D. In this case, occurrences of unusual sounds are inhibited by the contact section 560*a* coming into contact with the projecting sections 512 via the external additives that rotatively move on the projecting sections 512 (the external additives have separated from the toner) Detailed description is given regarding this point below.

The toner according to this embodiment is provided with core particles and four types of external additives that are externally added to the core particles (namely, 15 nm silica, 50 nm silica, 500 nm silica, and titania). And although these external additives can be made to separate from the core particles during use of the developing devices 51, 52, 53, and 54, as described earlier it is the 500 nm silica, which has the largest volume mean particle size among the four types of external additives, that readily separates from the core particles.

Figure 15:
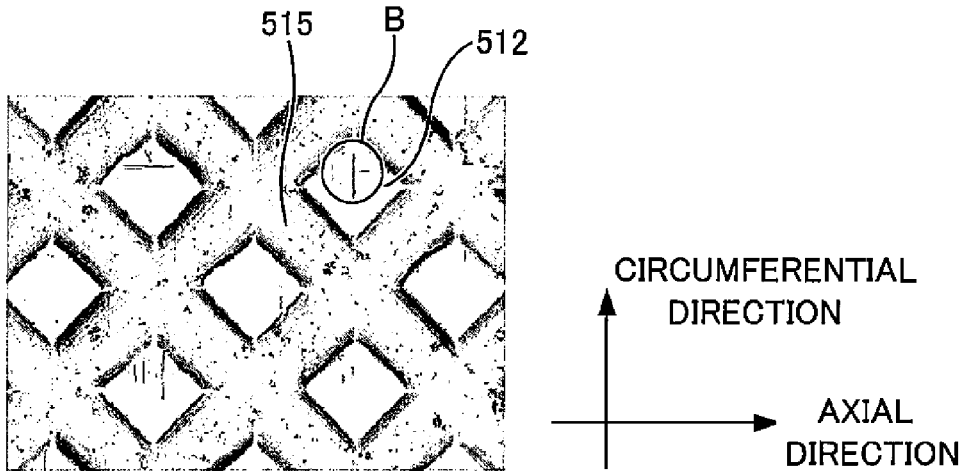
FIG. 15 is a diagram for illustrating the projecting sections 512 being rough.

External additive (500 nm silica) that has separated from the core particles is borne on the developing roller 510 (the projecting sections 512 and the depressed sections 515) in a same manner as the toner. In this regard, the projecting sections 512 are rough as shown in FIG. 15, and in this embodiment, a ten-point average roughness Rz of the projecting sections 512 is smaller than the volume mean particle size (500 nm) of the 500 nm silica (protrusion roughness C<external additive particle size B). For this reason, a portion of the 500 nm silica that has separated from the core particles becomes sandwiched in a jumped-out manner (see FIG. 17B) at areas where the projecting sections 512 are rough (specifically, small grooves 512*b* shown in FIG. 15). Here, the small grooves 512*b* are provided along the circumferential direction of the developing roller 510 and are formed at the time of processing the developing roller 510 (cutting processing and rolling processing). It should be noted that FIG. 15 is a diagram for illustrating the projecting sections 512 being rough.

Unlike the toner, the external additive (500 nm silica) borne on the projecting sections 512 (small grooves 512*b*) passes through the gap between the leading edge 560*b* of the regulation blade 560 and the opposing area 512*a* during rotation of the developing roller 510. This is because the volume mean particle size (500 nm) of the 500 nm silica is smaller than the distance g (approximately 2 μm) (the external additive particle size B<the distance D). It should be noted that in this embodiment, the external additive particle size B refers to the volume mean particle size of the 500 nm silica, which has the largest volume mean particle size among the four types of external additives.

Figure 16:
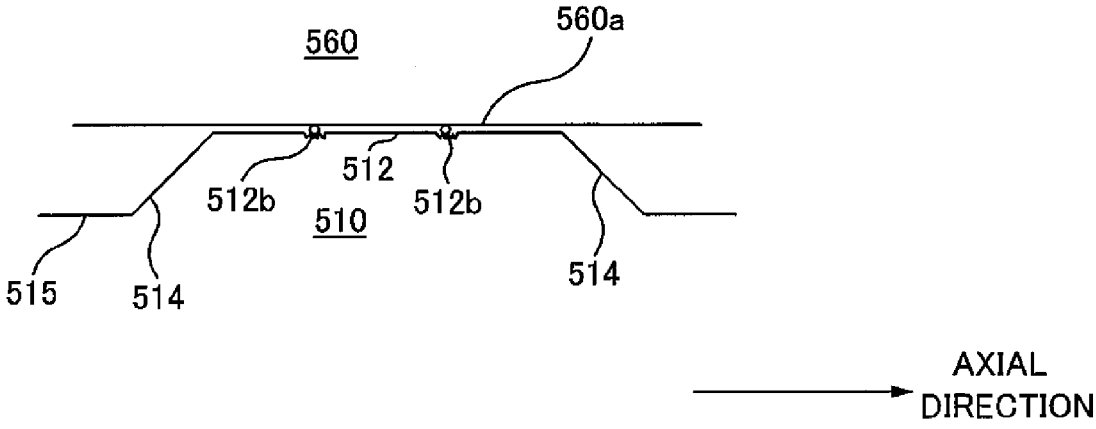
FIG. 16 is a schematic diagram that shows a state in which the contact section 560*a* comes into contact with the projecting sections 512 through the external additives.

The 500 nm silica that has passed between the leading edge 560*b* and the opposing area 512*a*, and that is borne on the projecting sections 512 (some of this 500 nm silica has jumped out from the projecting sections 512) moves along with the rotation of the developing roller 510 and makes contact with the contact section 560*a* of the regulation blade 560. Then, the 500 nm silica that is in contact with the contact section 560*a* is rotatively moved along with further rotation of the developing roller 510 while maintaining its state of contacting the contact section 560*a*. Thus, as shown in FIG. 16, while the 500 nm silica rolls, the contact section 560*a* comes into contact with the projecting sections 512 through the 500 nm silica (indicated by circles in FIG. 16). In this way, the surface area of the contact section 560*a* that comes into contact with the projecting sections 512 is decreased and it becomes more difficult for the contact section 560*a* to closely adhere to the projecting sections 512, and therefore occurrences of unusual sounds can be inhibited in the case where the developing roller 510 rotates. It should be noted that FIG. 16 is a schematic diagram that shows a state in which the contact section 560*a* comes into contact with the projecting sections 512 through the external additive.

Figure 17A:
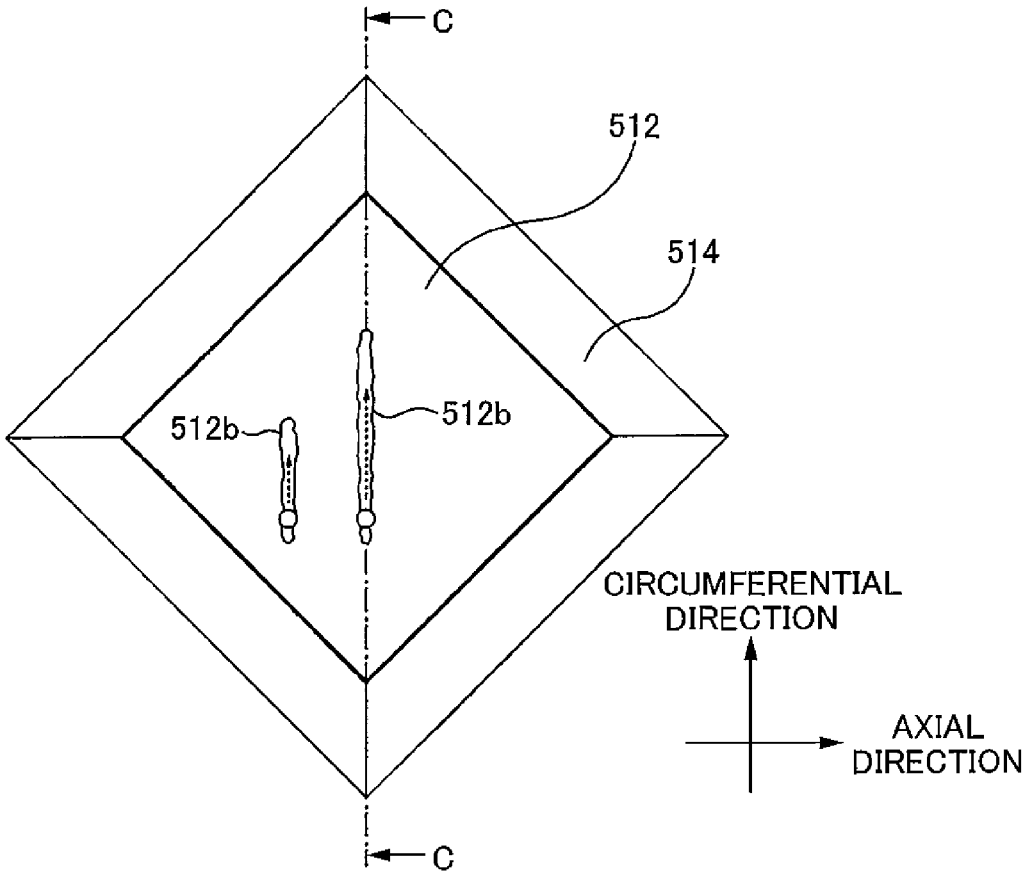
FIGS. 17A and 17B are schematic diagrams for describing a condition in which the toner borne on the projecting sections 512 roll.
Figure 17B:
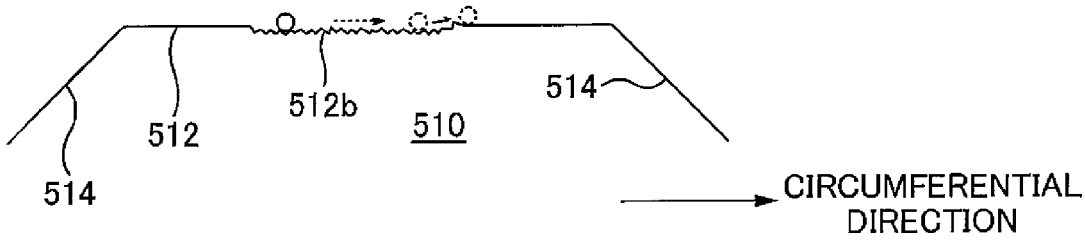

Here, as shown in FIG. 17A and FIG. 17B, the external additive (500 nm silica) rolls along the small grooves 512*b* formed in the projecting sections 512 on which the external additive has been borne. Specifically, the 500 nm silica rolls from the bottom toward the top in FIG. 17A. In this regard, as shown in FIG. 17A, the small grooves 512*b* are formed so that they do not connect from one end to the other end in the circumferential direction of the developing roller 510 across the projecting sections 512 on which the small grooves 512*b* are provided (in other words, the small grooves 512*b* do not connect to the lateral sections 514). In this case, the 500 nm silica, which is borne on the small grooves 512*b* and makes contact with the contact section 560*a*, rolls on the projecting sections 512 along with rotation of the developing roller 510 so that it runs up from the small grooves 512*b* (FIG. 17B). Then, along with these rolling movements of the 500 nm silica, the contact section 560*a* that makes contact with the 500 nm silica is shifted vertically up and down, and the contact section 560*a* is even more effectively prevented from adhering closely to the projecting sections 512. It should be noted that FIGS. 17A and 17B are schematic diagrams for describing a condition in which the toner borne on the projecting sections 512 rolls. Also note that FIG. 17B is a cross-sectional view taken along a line C-C of FIG. 17A.

In the above description, when a relationship of the protrusion roughness C<the external additive particle size B<the distance D is established, the external additive (500 nm silica) that has separated from the toner is borne on the roughened portions of the projecting sections 512 (namely, the small grooves 512*b*) and passes through the gap between the leading edge 560*b* and the opposing area 512*a*. Then, since the contact section 560*a* of the regulation blade 560 comes into contact with the projecting sections 512 through the external additives that roll on the small grooves 512*b*, the regulation blade 560 can be prevented from closely adhering to the projecting sections 512 and occurrences of the aforementioned unusual sounds can be inhibited.

Furthermore, the external additives work as a lubricant between the contact section 560*a* and the projecting sections 512, and due to the external additives, friction is reduced between the contact section 560*a* and the projecting sections 512 when the developing roller 510 rotates. For this reason, the load on the motor during rotation of the developing roller 510 is reduced and it is possible to prevent the torque required in rotating the developing roller 510 from increasing greatly.

Figure 18:
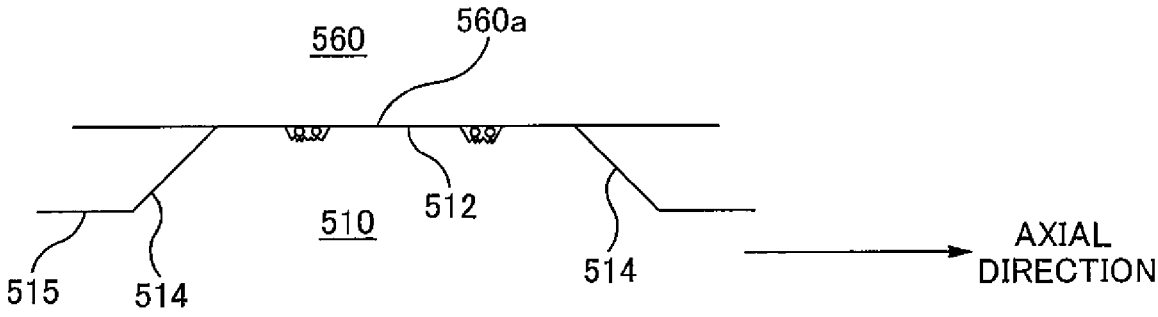
FIG. 18 is a schematic diagram for describing a comparative example.

In the description above, by establishing a relationship in which the protrusion roughness C<the external additive particle size B, the external additive (500 nm silica) is borne on the small grooves 512*b* of the projecting sections 512, but as shown in FIG. 18, in the case where the protrusion roughness C>the external additive particle size B, the external additives (also shown using circles in FIG. 18 as in FIG. 16) are borne on the small grooves 512*b* of the projecting sections 512. However, in this case, the external additives enter into the small grooves 512*b* and it is difficult for them to roll. And when the external additives enter into the small grooves 512*b*, the contact section 560*a* comes into direct contact with the projecting sections 512 without the external additives interposed therebetween, and occurrences of unusual sounds cannot be suppressed. FIG. 18 is a schematic diagram for describing a comparative example.

It should be noted that as described in the section "Inhibiting Effect on Development Memory Due to Regulation State Of Regulation Blade 560," when the distance D<the toner particle size A, occurrences of the development memory can be inhibited effectively and as a result, deterioration in the image quality of images is appropriately prevented. Accordingly, with the developing devices 51, 52, 53, and 54 according to this embodiment, by establishing a relationship in which the protrusion roughness C<the external additive particle size B<distance D<the toner particle size A, it is possible to appropriately prevent deterioration in image quality of images and to appropriately bring the regulation blade 560 into contact with the developing roller 510.

Developing device Manufacturing Method

Figure 19A:
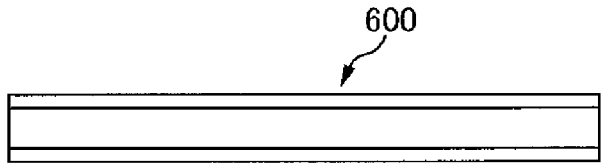
FIGS. 19A to 19E are schematic diagrams showing transitional states of the developing roller 510 during the manufacturing process thereof.
Figure 19B:
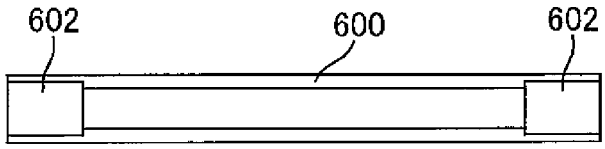
Figure 19C:
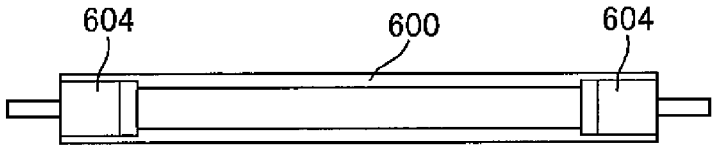
Figure 19D:
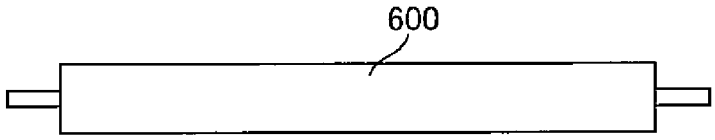
Figure 19E:
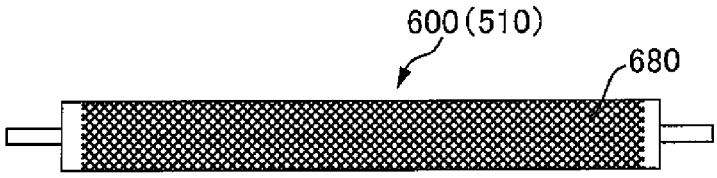
Figure 20:
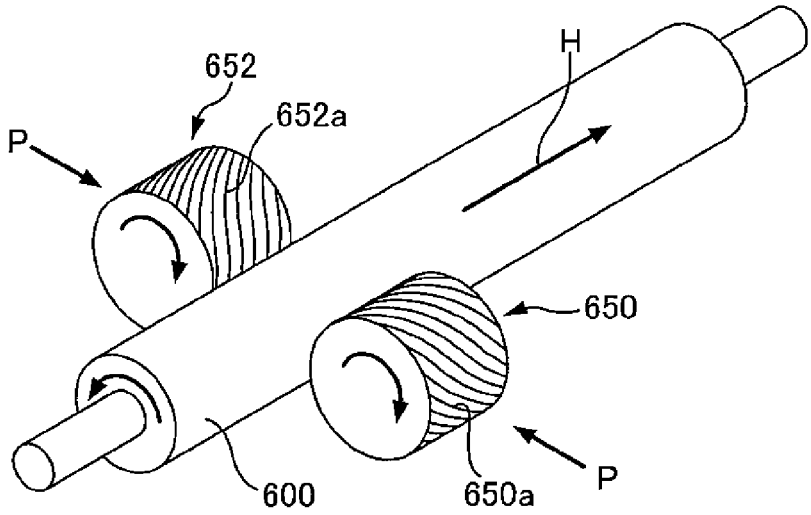
FIG. 20 is an explanatory diagram for describing the rolling process of the developing roller 510.
Figure 21:
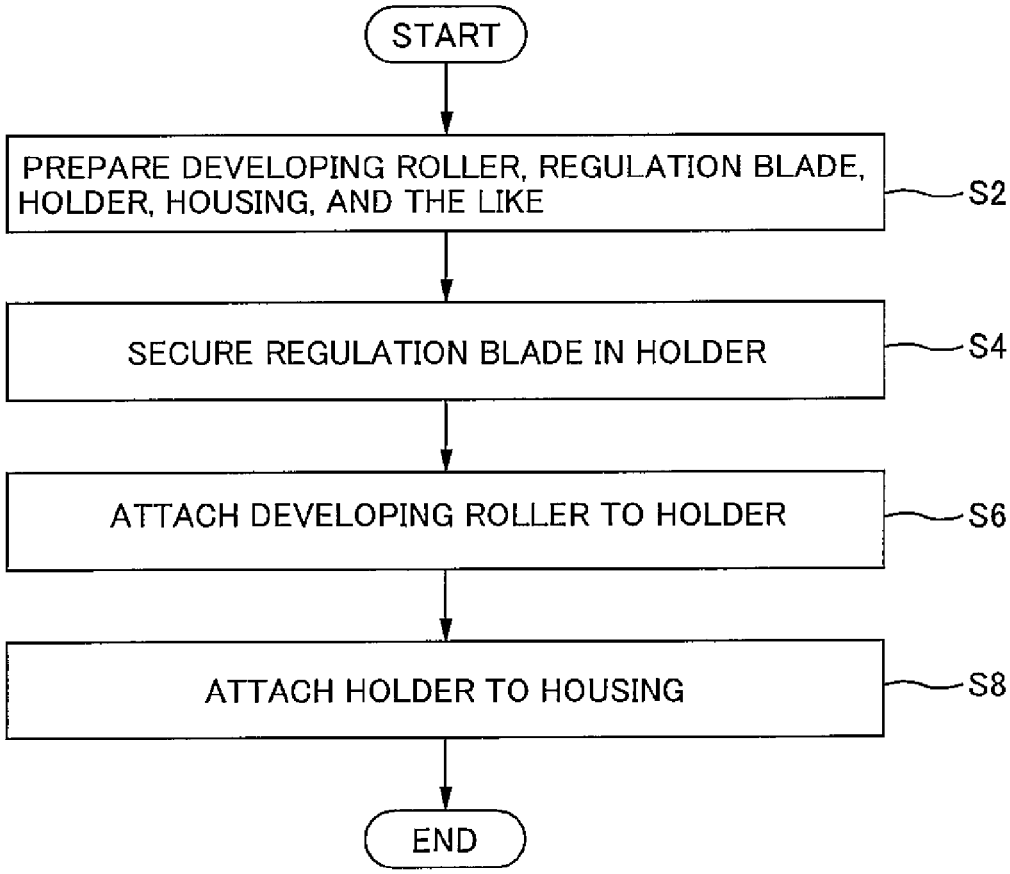
FIG. 21 is a flowchart for describing an assembly method for a yellow developing device 54.

Next, description is given regarding a method for manufacturing the developing devices with reference to FIGS. 19A to 21. FIGS. 19A to 19E are schematic diagrams showing transitional states of the developing roller 510 during the manufacturing process thereof. FIG. 20 is an explanatory diagram for describing the rolling process of the developing roller 510. FIG. 21 is a flowchart for describing an assembly method for the yellow developing device 54. It should be noted that in manufacturing the developing device, the above-described housing 540, holder 526, developing roller 510, toner supplying roller 550, regulation blade 560 and the like are manufactured first. Then, the developing device is manufactured by assembling these members. Now, among manufacturing methods for these members, the method for manufacturing the developing roller 510 is described first, and thereafter the method for assembling the developing device is described. In the following description, the yellow developing device 54 is taken as an example from among the black developing device 51, the magenta developing device 52, the cyan developing device 53, and the yellow developing device 54.

Method for Manufacturing the Developing Roller 510

The method for manufacturing the developing roller 510 is described with reference to FIG. 19A to FIG. 20.

First of all, as shown in FIG. 19A, a pipe member 600 is prepared, which is used as the base member of the developing roller 510. The wall thickness of this pipe member 600 is 0.5 to 3 mm. Then, as shown in FIG. 19B, flange press-fitting sections 602 are formed at the both ends in the longitudinal direction of the pipe member 600. The flange press-fitting sections 602 are made by a cutting process. Next, as shown in FIG. 19C, a flange 604 is injected to the flange press-fitting sections 602. In order to reliably fasten the flanges 604 to the pipe member 600, it is also possible to glue or weld the flanges 604 to the pipe member 600 after press-fitting the flanges 604. Next, as shown in FIG. 19D, the surface of the pipe member 600 to which the flanges 604 are injected is subjected to centerless grinding. This centerless grinding is performed on the entire surface, and the ten-point average roughness Rz of the surface after the centerless grinding is not equal to or less than 1.0 μm. Next, as shown in FIG. 19E, the pipe member 600 with the flanges 604 injected thereto is subjected to a rolling process. In this embodiment, a so-called through-feed rolling process (also referred to as "continuous rolling") using two round dies 650, 652 is performed.

That is, as shown in FIG. 20, the two round dies 650, 652 arranged so that they sandwich the pipe member 600 serving as the workpiece are rotated in the same direction (see FIG. 20) while being pressed with a predetermined pressure (the direction of this pressure is marked with the reference symbol P in FIG. 20) against the pipe member 600. In the through feed rolling, due to rotation of the round dies 650 and 652, the pipe member 600 moves in the direction indicated by the reference symbol H in FIG. 20 while rotating in the direction opposite to the rotating direction of the round dies 650 and 652 (see FIG. 20). Convex sections 650*a* and 652*a* for forming a groove 680 are provided respectively on the surface of the round dies 650 and 652. The convex sections 650*a* and 652*a* deform the pipe member 600 to form the groove 680 on the pipe member 600 (here the groove 680 corresponds to the first groove portion 516 and the second groove portion 518).

After completion of the rolling process, plating is performed on the surface of the central area 510*a*. In this embodiment, electroless Ni—P plating is employed. However, there is no limitation to this, and hard chrome plating or electroplating may be employed for example.

In the thus-manufactured developing roller 510, a size of a ten-point average roughness Rz of the projecting sections 512 is smaller than 500 nm (which is the volume mean particle size of the external additive 500 nm silica).

Method for Assembling the Yellow Developing Device 54

A method for assembling the yellow developing device 54 is described next with reference to FIG. 21.

First, the above-described housing 540, holder 526, developing roller 510, regulation blade 560, blade-supporting member 564, and the like are prepared (step S2).

Next, the regulation blade 560 and the blade-supporting member 564 are secured to the holder 526 as a result of the regulation blade 560 and the blade-supporting member 564 being fixed to the regulation blade support sections 526*c* of the holder 526 with screws (step S4). It should be noted that the aforementioned end seal 574 is attached to the regulation blade 560 ahead of this step S4.

Next, the developing roller 510 is attached to the holder 526 to which the regulation blade 560 and the blade-supporting member 564 have been secured (step S6). At this time, the developing roller 510 is attached to the holder 526 so that the regulation blade 560 comes into contact with the developing roller 510 through one end to the other end in the rotation-axis direction of the developing roller 510. The aforementioned upper seal 520 is attached to the holder 526 ahead of this step S6.

Then, the holder 526 to which the developing roller 510, regulation blade 560 and the like have been attached, is attached to the housing 540 via the housing seal 546 (step S8), thereby completing assembly of the yellow developing device 54. It should be noted that the aforementioned toner supply roller 550 is attached to the housing 540 ahead of this step S8.

Other Embodiments

A developing device or the like according to the invention was described by way of the foregoing embodiment, but the foregoing embodiment of the invention is merely for the purpose of elucidating the invention and is not to be interpreted as limiting the invention. The invention can of course be altered and improved without departing from the gist thereof and equivalents are intended to be embraced therein.

In the foregoing embodiment, an intermediate transferring type full-color laser beam printer was described as an example of the image forming apparatus, but the invention can also be applied to various other types of image forming apparatuses, such as full-color laser beam printers that are not of the intermediate transferring type, monochrome laser beam printers, copying machines, and facsimile machines.

Moreover, the photoconductor is not limited to a so-called photosensitive roller, which is configured by providing a photoconductive layer on the outer circumferential surface of a cylindrical conductive base, and can also be a so-called photoconductive belt, which is configured by providing a photoconductive layer on the surface of a belt-shaped conductive base.

Furthermore, in the foregoing embodiment, the projecting sections 512 and the depressed sections 515, which bear the toner, were arranged in a regular manner on the surface of the developing roller 510. Furthermore, the depressed sections 515 were bottom portions of two types of spiral groove portions (the first groove portion 516 and the second groove portion 518) having different inclination angles with respect to the circumferential direction of the developing roller 510, and the two types of spiral groove portions mutually intersected so as to form a grid pattern. Further still, the projecting sections 512 were square top surfaces surrounded by the two types of spiral groove portions, and one of two diagonal lines of the square top surface runs along the circumferential direction. However, there is no limitation to this. For example, the projecting sections 512 maybe rhomboid top surfaces or circular top surfaces or the like.

Furthermore, in the foregoing embodiment, the small grooves 512*b* were provided that were formed in the projecting sections 512 during processing of the developing roller 510 as shown in FIG. 15 and that runs along the circumferential direction of the developing roller 510, but there is not limitation to this. For example, the small grooves 512*b* may be provided so as to run along the rotation-axis direction.

However, in the case where the small grooves 512*b* are provided running along the circumferential direction, the external additives borne on the small grooves 512*b* and that makes contact with the contact section 560*a* at the time the developing roller 510 rotates are more easily caused to roll along the small grooves 512*b*, thereby enabling effective prevention of the contact section 560*a* adhering closely to the projecting sections 512, and in regard to this point the above-described embodiment is more preferable.

Furthermore, in the foregoing embodiment, the small grooves 512*b* were provided as shown in FIG. 17A so as to not connect from one end to the other end in the circumferential direction of the developing roller 510 across the projecting sections 512 on which the small grooves 512*b* are provided, but there is no limitation to this. For example, the small grooves 512*b* may be provided connecting from one end to the other end of the projecting sections 512.

However, in the case where the small grooves 512*b* are provided so as to not connect from the one end to the other end, when the external additives borne on the small grooves 512*b* and that makes contact with the contact section 560*a* roll so as to run up from the small grooves 512*b* (see FIG. 17B), the contact section 560*a* shifts vertically up and down, thereby enabling the contact section 560*a* to be prevented more effectively from closely adhering to the projecting sections 512, and in regard to this point the above-described embodiment is more preferable.

Furthermore, in the foregoing embodiment, the toner had four types of external additives that were externally added to the core particles, and the external additive particle size B was set as the volume mean particle size of the external additive (500 nm silica) having the largest volume mean particle size among the four types of external additives, but there is no limitation to this. For example, the external additive particle size B may be the volume mean particle size of an external additive other than the 500 nm silica of the four types of the external additives.

However, in the case where the external additive particle size B is the volume mean particle size of 500 nm silica, the 500 nm silica, which is most easily separated among the four types of external additives, is borne on the small grooves 512*b* and rolls in the small grooves 512*b*, thereby enabling more effective prevention of the contact section 560*a* adhering closely to the projecting sections 512, and in regard to this point the above-described embodiment is more preferable.

Furthermore, in the foregoing embodiment, the regulation blade 560 was constituted by a rubber elastic member (urethane rubber or the like), but there is no limitation to this. For example, the regulation blade 560 may be constituted by a sheet metal.

However, as is described below, the effect of causing the regulation blade 560 to appropriately come into contact with the projecting sections 512 is more effectively achieved, and in regard to this point, the above-described embodiment is more preferable. Compared to sheet metal, a rubber elastic member more readily has a larger surface area for coming into contact with the projecting sections 512, and therefore tends to easily adhere closely to the developing roller 510. For this reason, in the case where the regulation blade 560 is constituted by a rubber elastic member, the effect due to establishing a relationship in which the protrusion roughness C<the external additive particle size B<the distance D, that is, the effect of appropriately bringing the contact section 560*a* into contact with the projecting sections 512 is more effectively achieved.

Configuration of the Image Forming System, etc.

Next, an embodiment of an image forming system serving as an example of an embodiment of the invention is described with reference to the drawings.

Figure 22:
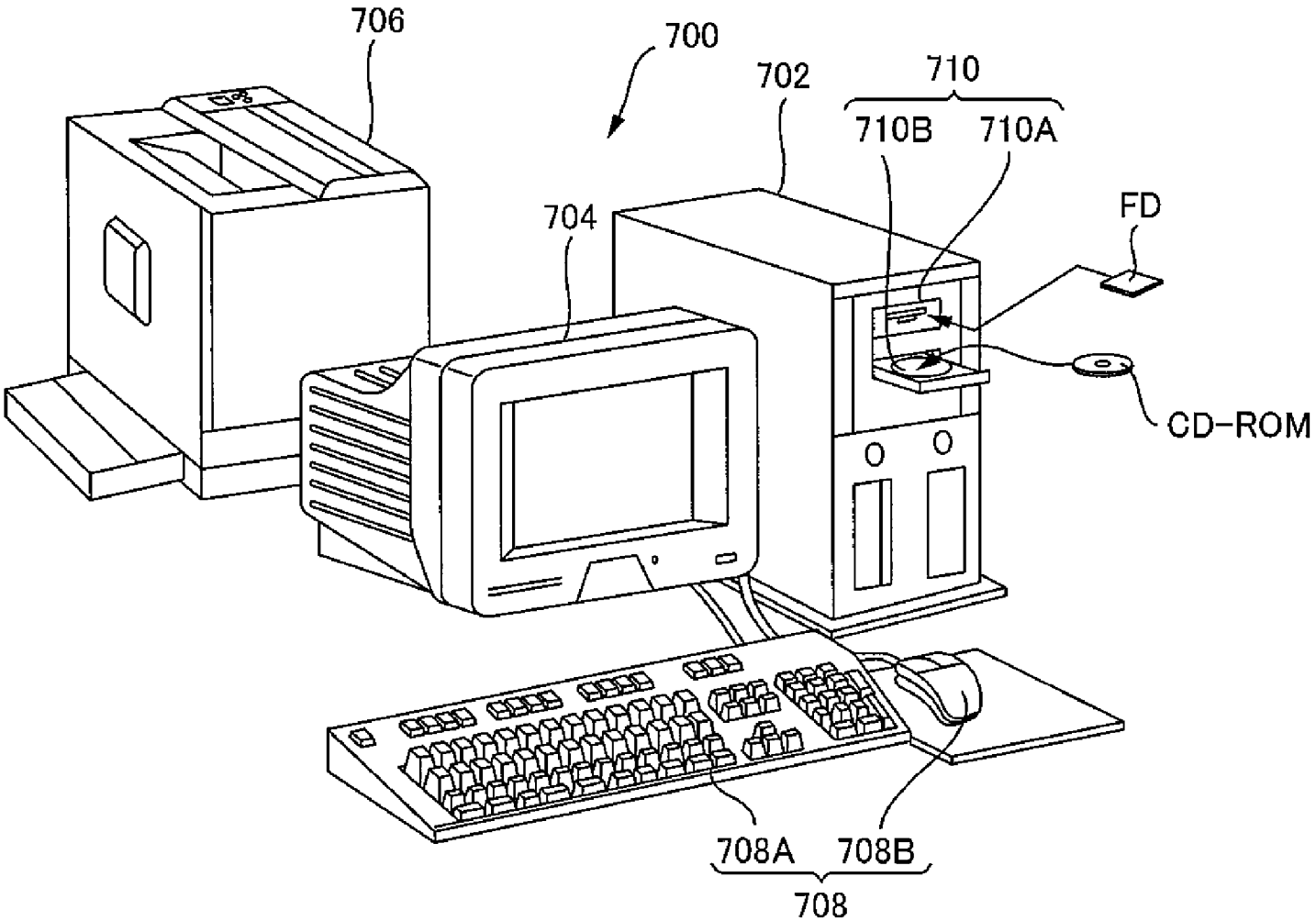
FIG. 22 is an explanatory diagram showing an external configuration of an image forming system.

FIG. 22 is an explanatory diagram showing an external configuration of an image forming system. An image forming system 700 is provided with a computer 702, a display device 704, a printer 706, input devices 708, and reading devices 710. In this embodiment, the computer 702 is contained within a mini-tower type housing, but there is no limitation to this. A CRT (cathode ray tube), a plasma display, or a liquid crystal display device, for example, is generally used as the display device 704, but there is no limitation to these. The printer described above is used as the printer 706. In this embodiment, the input devices 708 are a keyboard 708A and a mouse 708B, but there is no limitation to these. In this embodiment, a flexible disk drive device 710A and a CD-ROM drive device 710B are used as the reading device 710, but the reading device 710 is not limited to these, and it may also be an MO (magnet optical) disk drive device or a DVD (digital versatile disk), for example.

Figure 23:
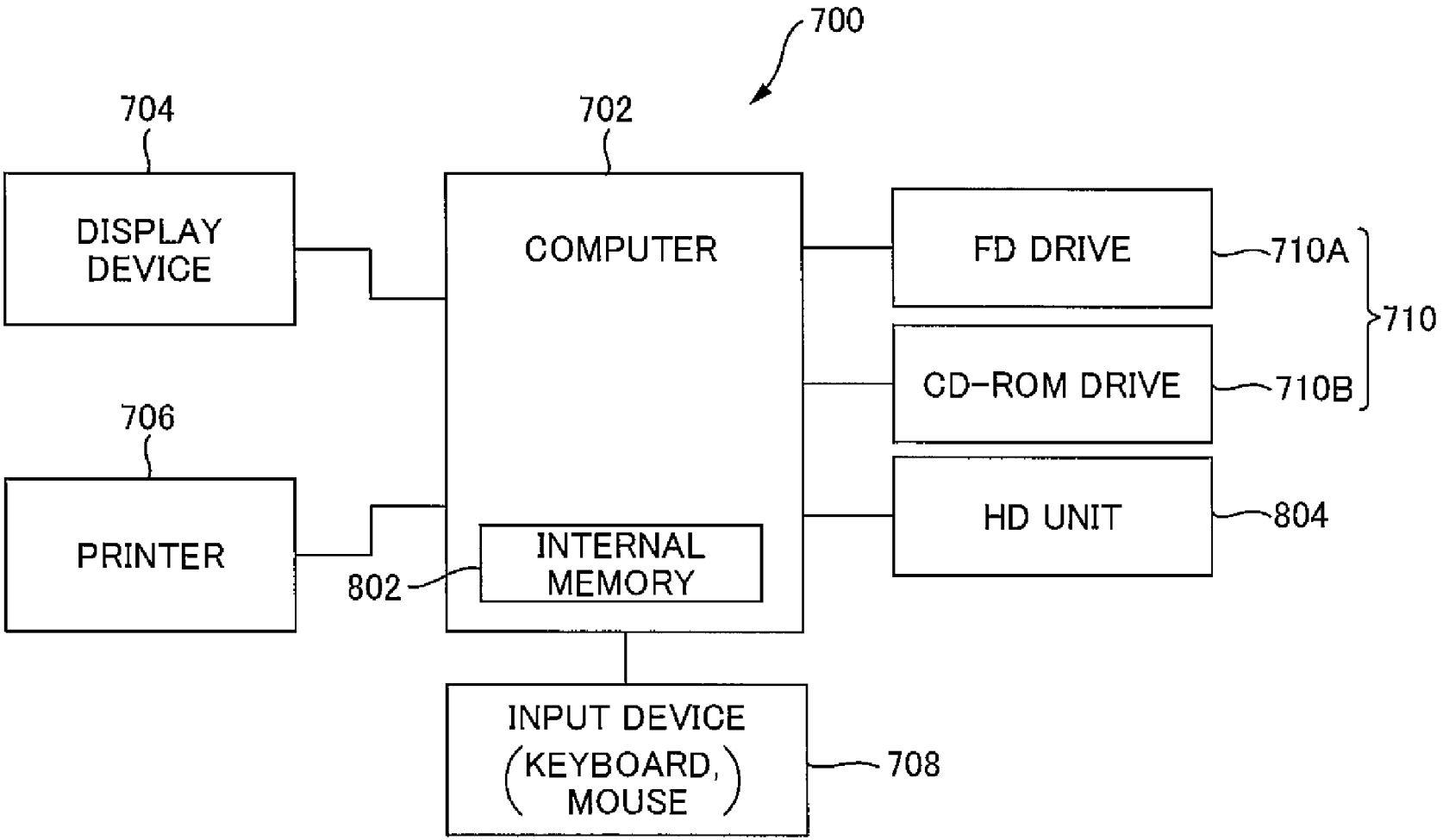
FIG. 23 is a block diagram showing the configuration of the image forming system shown in FIG. 22.

FIG. 23 is a block diagram showing the configuration of the image forming system shown in FIG. 22. An internal memory 802 such as a RAM is provided within the casing containing the computer 702, and furthermore an external memory such as a hard disk drive unit 804 is provided.

In the above explanations, an example was given in which the image forming system is constituted by connecting the printer 706 to the computer 702, the display device 704, the input devices 708 and the reading devices 710, but there is no limitation to this. For example, the image forming system may also be made of the computer 702 and the printer 706, and the image forming system does not have to be provided with any of the display device 704, the input devices 708, and the reading devices 710.

It is also possible that the printer 706 for example has some of the functions or mechanisms of the computer 702, the display device 704, the input devices 708, and the reading devices 710. For example, the printer 706 may be configured so as to have an image processing section for carrying out image processing, a display section for carrying out various types of displays, and a recording media mount/dismount section into and from which recording media storing image data captured by a digital camera or the like are inserted and taken out.

As an overall system, the image forming system that is thus achieved is superior to conventional systems.

Although the preferred embodiment of the invention has been described in detail, it should be understood that various changes, substitutions and alterations can be made therein without departing from spirit and scope of the inventions as defined by the appended claims.

What is claimed is:

1. A developing device, comprising:

a toner bearing member that bears toner that has core particles and a particulate external additive externally added to the core particles, and that develops a latent image borne on an image bearing member using the toner, the toner bearing member being rotatable and having projecting sections arranged in a regular manner on a surface of the toner bearing member; and a regulation member that regulates an amount of toner borne on a surface of the toner bearing member by coming into contact with that surface at a contact section, the regulation member being arranged so that a longitudinal direction of the regulation member runs along an axial direction of the toner bearing member, and so that a leading edge of the regulation member in a lateral direction and a thickness direction faces an upstream side in a rotating direction of the toner bearing member, wherein in the case where a volume mean particle size of the toner is set to a toner particle size A, a volume mean particle size of the external additive is set to an external additive particle size B, a ten-point average roughness of the projecting sections is set to a protrusion roughness C, and a distance between the leading edge and the projecting sections in the case where the leading edge of the regulation member faces the projecting sections is set to a distance D, a relationship among sizes of the toner particle size A, the external additive particle size B, the protrusion roughness C, and the distance D is so that the protrusion roughness C<the external additive particle size B<the distance D<the toner particle size A.

2. A developing device according to claim 1, wherein the projecting sections and depressed sections that bear the toner are arranged in a regular manner on a surface of the toner bearing member, the depressed sections are bottom portions of two types of spiral groove portions having different inclination angles with respect to a circumferential direction of the toner bearing member, the two types of spiral groove portions mutually intersect so as to form a grid pattern, the projecting sections are a square top surface surrounded by the two types of spiral groove portions, and one of two diagonal lines of the square top surface runs along the circumferential direction.

3. A developing device according to claim 2, wherein a small groove that is formed during processing of the toner bearing member and that runs along the circumferential direction of the toner bearing member is provided on the projecting sections.

4. A developing device according to claim 3, wherein the small groove is provided so as to not connect from one end to another end in the circumferential direction of the protrusion on which the small groove is provided.

5. A developing device according to claim 1, wherein the toner is provided with a plurality of types of the external additives that are externally added to the core particles, and the external additive particle size B is a volume mean particle size of an external additive having a largest volume mean particle size among the plurality of types of external additives.

6. A developing device according to claim 1, wherein the regulation member is constituted by a rubber elastic member.

7. An image forming apparatus comprising a developing device, the developing device including (a) an image bearing member for bearing a latent image, (b) a toner bearing member that bears toner that has core particles and a particulate external additive externally added to the core particles, and that develops the latent image borne on the image bearing member using the toner, the toner bearing member being rotatable and having projecting sections arranged in a regular manner on a surface of the toner bearing member, and (c) a regulation member that regulates an amount of toner borne on a surface of the toner bearing member by coming into contact with that surface of the toner bearing member at a contact section, the regulation member being arranged so that a longitudinal direction of the regulation member runs along an axial direction of the toner bearing member, and so that a leading edge of the regulation member in a lateral direction and a thickness direction faces an upstream side in a rotating direction of the toner bearing member, wherein when a volume mean particle size of the toner is set to a toner particle size A, a volume mean particle size of the external additive is set to an external additive particle size B, a ten-point average roughness of the projecting sections is set to a protrusion roughness C, and a distance between the leading edge and the projecting sections when the leading edge of the regulation member faces the projecting sections is set to a distance D, the developing device is so that a relationship among sizes of the toner particle size A, the external additive particle size B, the protrusion roughness C, and the distance D is so that the protrusion roughness C<the external additive particle size B<the distance D<the toner particle size A.

8. An image forming system equipped with:

(A) a computer; and (B) an image forming apparatus that is connectable to the computer, the image forming apparatus including a developing device provided with (a) an image bearing member for bearing a latent image, (b) a toner bearing member that bears toner that has core particles and a particulate external additive externally added to the core particles, and that develops the latent image borne on the image bearing member using the toner, the toner bearing member being rotatable and having projecting sections arranged in a regular manner on a surface of the toner bearing member, and (c) a regulation member regulates an amount of toner borne on a surface of the toner bearing member by coming into contact with that surface of the toner bearing member at a contact section and, the regulation member being arranged so that a longitudinal direction of the regulation member runs along an axial direction of the toner bearing member, and so that a leading edge of the regulation member in a lateral direction and a thickness direction faces an upstream side in a rotating direction of the toner bearing member, wherein when a volume mean particle size of the toner is set to a toner particle size A, a volume mean particle size of the external additive is set to an external additive particle size B, a ten-point average roughness of the projecting sections is set to a protrusion roughness C, and a distance between the leading edge and the projecting sections in the case where the leading edge of the regulation member faces the projecting sections is set to a distance D, the developing device is so that a relationship among sizes of the toner particle size A, the external additive particle size B, the protrusion roughness C, and the distance D is so that the protrusion roughness C<the external additive particle size B<the distance D<the toner particle size A.

* * * * *